US009973855B2

(12) United States Patent
Jung et al.

(10) Patent No.: US 9,973,855 B2
(45) Date of Patent: May 15, 2018

(54) METHOD AND ELECTRONIC DEVICE FOR CONTROLLING OUTPUT DEPENDING ON TYPE OF EXTERNAL OUTPUT DEVICE

(71) Applicant: Samsung Electronics Co., Ltd., Suwon-si, Gyeonggi-do (KR)

(72) Inventors: Euichan Jung, Gumi-si (KR); Minwoo Song, Gumi-si (KR); Chulhyung Yang, Gumi-si (KR); Jiwoo Lee, Gumi-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days. days.

(21) Appl. No.: 15/181,911

(22) Filed: Jun. 14, 2016

(65) Prior Publication Data

US 2017/0026752 A1 Jan. 26, 2017

(30) Foreign Application Priority Data

Jul. 20, 2015 (KR) ..... 10-2015-0102662

(51) Int. Cl.
*H04R 1/10* (2006.01)
*H04R 5/04* (2006.01)
*H04R 29/00* (2006.01)

(52) U.S. Cl.
CPC ..... *H04R 5/04* (2013.01); *H04R 29/001* (2013.01); *H04R 2420/05* (2013.01)

(58) Field of Classification Search
CPC ..... H04R 2420/05; H04R 5/04; H04R 29/001
See application file for complete search history.

(56) References Cited

U.S. PATENT DOCUMENTS

| | | | | |
|---|---|---|---|---|
| 6,069,960 | A | 5/2000 | Mizukami et al. | |
| 2004/0080440 | A1 | 4/2004 | Su et al. | |
| 2004/0081099 | A1 | 4/2004 | Patterson et al. | |
| 2006/0034465 | A1 | 2/2006 | Jeong | |
| 2008/0318629 | A1 | 12/2008 | Inha et al. | |
| 2011/0099298 | A1 | 4/2011 | Chadbourne et al. | |
| 2011/0216912 | A1 | 9/2011 | Seo | |
| 2017/0111742 | A1* | 4/2017 | Forman | H04R 5/04 |

FOREIGN PATENT DOCUMENTS

| | | | |
|---|---|---|---|
| JP | 2005-31820 | A | 11/2005 |
| KR | 10-2011-0100728 | A | 9/2011 |
| WO | 2004/001552 | A2 | 12/2003 |
| WO | 2006/045617 | A2 | 5/2006 |

* cited by examiner

*Primary Examiner* — Regina N Holder
(74) *Attorney, Agent, or Firm* — Jefferson IP Law, LLP

(57) ABSTRACT

An electronic device and a method for controlling output through an external output device are provided. The electronic device includes a housing, a receptacle formed so as to receive one of a first external connector and a second external connector, and a circuit electrically coupled to the receptacle. The first external connector includes first, second, third, and fourth terminals. The second external connector includes first, second, third, and fourth terminals. The circuit is configured to detect whether one of the first and second external connectors is inserted into the receptacle, and, based on results of detection, provide an audio output to the first external connector in a first manner if the first external connector is inserted, and provide the audio output to the second external connector in a second manner different from the first manner if the second external connector is inserted.

20 Claims, 22 Drawing Sheets balanced
(Case#2)

balanced (5-Pole Jack)

5-Pole Jack (Insert State)

METHOD AND ELECTRONIC DEVICE FOR CONTROLLING OUTPUT DEPENDING ON TYPE OF EXTERNAL OUTPUT DEVICE

CROSS-REFERENCE TO RELATED APPLICATION(S)

This application claims the benefit under 35 U.S.C. § 119(a) of a Korean patent application filed on Jul. 20, 2015 in the Korean Intellectual Property Office and assigned Serial number 10-2015-0102662, the entire disclosure of which is hereby incorporated by reference.

TECHNICAL FIELD

The present disclosure relates to a method for supporting an external output device based on type thereof and also to an electronic device implementing the method.

BACKGROUND

Recently, a great variety of electronic devices such as smart phones, tablet personal computers (PCs), digital cameras, Moving Picture Experts Group phase 1 or phase 2 (MPEG-1 or MPEG-2) audio layer III (MP3) players, and electronic books have been widely used. Normally, such an electronic device may be connected to an external output device (e.g., an earphone, a headset, etc.) and may support the output of an unbalanced type earphone being capable of a wired call. In general, the electronic device may support a microphone (MIC) embedded in the external output device and, even though no MIC is embedded in the external output device, may support the output of an unbalanced audio signal. Also, the electronic device may have therein a connector joint part (e.g., a socket, a receptacle) for the connection with a connector (e.g., an ear jack) of an earphone, and the ear jack of the earphone may be formed of a 4-pole terminal. The 4-pole terminal may be designed as a standard terminal for supporting the unbalanced type earphone being capable of a wired call. Earphones may be classified into an unbalanced type and a balanced type. Generally, a balanced type earphone may output audio with high performance in comparison to an unbalanced type earphone.

Audio signals transmitted by the electronic device may be classified into a balanced type audio signal and an unbalanced type audio signal. Such different types of audio signals require different configurations of an output terminal. For example, unbalanced type audio signals may be formed of R signal, L signal, G signal and M signal, whereas balanced type audio signals may be formed of L+ signal, L− signal, R+ signal and R− signal. Normally, the electronic device fails to support audio signals based on a balanced type. Therefore, even though a balanced type earphone or headset is connected, the electronic device can hardly output high quality audio based on a balanced type.

Meanwhile, in order to support a balanced type output device (e.g., an earphone, a headset, etc.), a converter device may be further required. Namely, the electronic device needs an additional converter device so as to be compatible with the balanced type output device. The additional converter device may receive an unbalanced audio signal from the electronic device and then output an signal by performing a phase inversion from a signal of a right channel (a right output part) or of a left channel (a left output part) to a plus (+) signal or a minus (−) signal through a differential amplifier equipped therein.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an electronic device implementing a method for supporting an external output device based on type thereof.

In case an audio output device (e.g., a balanced type or an unbalanced type) is connected, an electronic device according to various embodiments of the present disclosure may change a circuit configuration thereof on the basis of the audio output device without the connection of any additional converter device. Namely, in various embodiments, an electronic device may implement a method for supporting both a balanced type audio output and an unbalanced type audio output without requiring the connection of any additional converter device.

Further, an electronic device according to various embodiments of the present disclosure may support a suitable audio output for a 4-pole ear jack, a 3-pole ear jack, or a 5-pole ear jack by compatibly changing a circuit configuration. Also, even in case of providing a microphone (MIC) function, an electronic device may support both a balanced type audio output and an unbalanced type audio output.

In accordance with an aspect of the present disclosure, an electronic device is provided. The electronic device includes a housing, a receptacle formed at a part of the housing so as to receive one of a first external connector and a second external connector, and a circuit electrically coupled to the receptacle. The first external connector may include first, second, third, and fourth terminals, and the second external connector may include first, second, third and fourth terminals which are arranged equally to those of the first external connector. The circuit may detect whether one of the first and second external connectors is inserted into the receptacle. Based on results of the detection, the circuit may provide an audio output of first type to the first external connector in case of insertion of the first external connector and also provide an audio output of a second type, different from the first type, to the second external connector in case of insertion of the second external connector.

In accordance with another aspect of the present disclosure, and electronic device is provided. The electronic device includes a housing, a receptacle formed at a part of the housing so as to receive one of a first external connector and a second external connector, and a circuit electrically coupled to the receptacle. The first external connector includes first, second, third, and fourth terminals. The second external connector includes first, second, third, fourth, and fifth terminals. The circuit is configured to detect whether one of the first and second external connectors is inserted into the receptacle, and, based on results of the detection, provide an audio output to the first external connector in a first manner when the first external connector is inserted, and provide the audio output to the second external connector in a second manner different from the first manner when the second external connector is inserted.

In accordance with another aspect of the present disclosure, a method for controlling output through an external output device is provided. The method includes recognizing an insertion of a first external connector or a second external connector, each of which includes first, second, third, and fourth terminals, through a receptacle for receiving one of the first external connector and the second external connector, detecting whether the inserted external connector is the first external connector or the second external connector, based on results of the detection, providing an audio output to the first external connector in a first manner when the first external connector is inserted, and based on the results of the detection, providing the audio output to the second external connector in a second manner being different from the first manner when the second external connector is inserted.

In accordance with another aspect of the present disclosure, a method for controlling output through an external output device is provided. The method includes recognizing an insertion of a first external connector including first, second, third, and fourth terminals or a second external connector including first, second, third, fourth, and fifth terminals through a receptacle for receiving one of the first external connector and the second external connector, detecting whether the inserted external connector is the first external connector or the second external connector, based on results of the detection, providing an audio output to the first external connector in a first manner when the first external connector is inserted, and based on the results of the detection, providing the audio output to the second external connector in a second manner different from the first manner when the second external connector is inserted According to various embodiments disclosed herein, an electronic device may improve user convenience by supporting a balanced type output device as well as an unbalanced type output device. Particularly, this may allow a user to hear higher quality audio.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
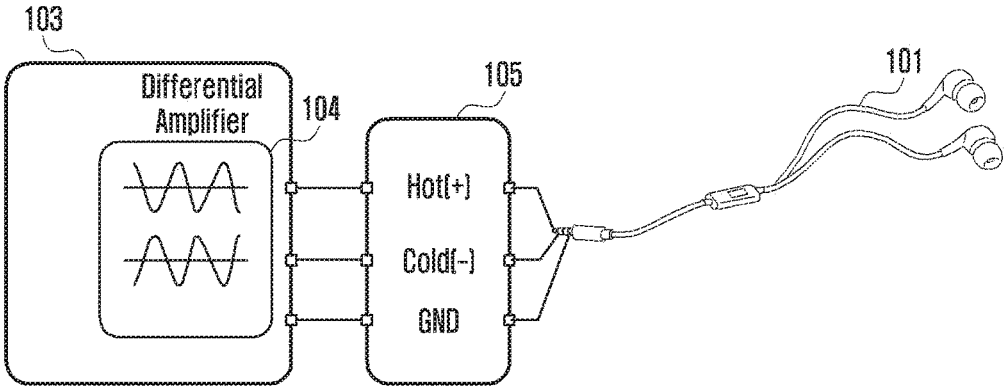
FIG. 1 is a diagram illustrating a balanced type earphone according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

It will be understood that the expressions "comprises" and "may comprise" is used to specify presence of disclosed function, operation, component, etc. but do not preclude the presence of one or more functions, operations, components, etc. It will be further understood that the terms "comprises" and/or "has" when used in this specification, specify the presence of stated feature, number, operation, component, element, or a combination thereof but do not preclude the presence or addition of one or more other features, numbers, operations, components, elements, or combinations thereof. In the present disclosure, the expression "and/or" is taken as specific disclosure of each and any combination of enumerated things. For example, A and/or B is to be taken as specific disclosure of each of A, B, and A and B.

As used herein, terms such as "first," "second," etc. are used to describe various components, however, it is obvious that the components should not be defined by these terms. For example, the terms do not restrict the order and/or importance of the corresponding components. The terms are used only for distinguishing one component from another component. For example, a first component may be referred to as a second component and likewise, a second component may also be referred to as a first component, without departing from the teaching of the present disclosure.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present.

The term "output device" used in various embodiments refers to an apparatus connected to an electronic device and outputting an audio signal. For example, the output device such as an earphone or a headset may receive an audio signal from the electronic device and then output the received audio signal. Such output devices may be classified into a balanced type and an unbalanced type, and most electronic devices support in general the unbalanced type output device. In order to support the balanced type output device, the electronic device requires an additional component equipped therein or a separate converter. In this disclosure, the terms "output device" and "external output device" have the same meaning.

The term "external output device connector" used in various embodiments refers to a jack of the external output device for the connection with the electronic device. The external output device connector may be also referred to as "an external connector". Such a connector of the external output device may be configured to transmit and receive an audio signal to and from the electronic device and may be classified into a 3-pole connector, a 4-pole connector, and a 5-pole connector. A part of the electronic device for the connection with the connector of the external output device is referred to as "a connector joint part". This connector joint part may be formed at one face of the electronic device and may have the shape of a hole into which the connector of the external output device will be inserted. The connector joint part may be also referred to as a socket, a receptacle, or the like. In order to transmit an audio signal to the connector, the connector joint part allows some contact parts being in contact with the connector to be electrically coupled to a processor. For example, a 4-pole connector may be formed of a TIP terminal, a RING1 terminal, a RING2 terminal, and a SLEEVE terminal, and the connector joint part may have a suitable structure for being electrically coupled to the corresponding terminals.

Unless otherwise defined herein, all terms including technical or scientific terms used herein have the same meanings as commonly understood by those skilled in the art to which the present disclosure belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein.

According to various embodiments of the present disclosure, the electronic device may include devices having an operation support function. Examples of the electronic device may include smartphone, tablet personal computer (PC), mobile phone, video phone, electronic book (e-book) reader, desktop PC, laptop PC, netbook computer, personal digital assistant (PDA), portable multimedia player (PMP), Moving Picture Experts Group phase 1 or phase 2 (MPEG-1 or MPEG-2) audio layer 3 (MP3) player, mobile medical appliance, camera, wearable device (e.g. head-mounted device (HMD) such as electronic glasses, electronic clothing, electronic bracelet, electronic necklace, electronic appcessory, electronic tattoo, smartwatch, etc.

According to an embodiment, the electronic device may be one of smart home appliances having operation support function. Examples of the smart electronic appliance as an electronic device may include television (TV), digital versatile disc (DVD) player, audio player, refrigerator, air-conditioner, vacuum cleaner, electronic oven, microwave oven, laundry machine, air cleaner, set-top box, TV box (e.g. Samsung HomeSync™, Apple TV™, and Google TV™), game console, electronic dictionary, electronic key, camcorder, and electronic frame, etc.

According to an embodiment, examples of the electronic device may include medical device (e.g. magnetic resonance angiography (MRA), magnetic resonance imaging (MRI), computed tomography (CT)), navigation device, global positioning system (GPS) receiver, event data recorder (EDR), flight data recorder (FDR), car infotainment device, maritime electronic device (e.g. maritime navigation device and gyro compass), aviation electronic device (avionics), security device, vehicle head unit, industrial or home robot, automatic teller's machine (ATM) of financial institution, point of sales (POS), etc.

According to an embodiment, examples of the electronic device may include furniture and building/structure having a communication function, electronic board, electronic signature receiving device, projector, and metering device (e.g. water, electric, gas, and electric wave metering devices). According to various embodiments, the electronic device may be any combination of the aforementioned devices. According to various embodiments of the present disclosure, the electronic device may be a flexible device. It is obvious to those skilled in the art that the electronic device is not limited to the aforementioned devices.

Descriptions are made of the electronic devices according to various embodiments with reference to accompanying drawings hereinafter. The term 'user' used in various embodiments may denote a person or a device (e.g. artificial intelligent electronic device) using the electronic device.

FIG. 1 is a diagram illustrating a balanced type earphone according to various embodiments of the present disclosure.

Referring to FIG. 1, shown are a balanced type earphone 101 and the output of an audio signal according to a balanced type. The balanced type earphone 101 is an example of a balanced type external output device, but the external output device is not limited to such an earphone.

A connector (e.g., an ear jack, an audio jack) 105 of the balanced type earphone 101 may be formed of three terminals, which may be represented as hot (+), cold (−), and ground (GND). Compared with this, an unbalanced type may be merely formed of a single signal and GND without distinguishing a plus signal from a minus signal. The balanced type earphone 101 may be connected to an electronic device 103. The electronic device 103 has a differential amplifier 104 therein and has the ability to distinguish a hot (+) signal from a cold (−) signal through the differential amplifier.

The balanced audio output is superior to the unbalanced audio output in cross-talk performance by about 30 dB, in total harmonic distortion (THD) by about 10 dB (based on 1 kHz, 0.001%−100 dB), and in dynamic range by about 5 dB. In case of the balanced audio output having a pair of a signal (a plus signal, hot (+)) and a phase-conversion signal (a minus signal, cold (−)), the electronic device may offset noise through phase conversion even though such a signal pair has an input of noise components. Namely, the balanced audio output has a noise robust feature, compared with the unbalanced audio output.

The electronic device according to various embodiments of the present disclosure may support the audio output of both balanced type and unbalanced type without the connection of any additional converter device. For example, in case a wired audio output device is connected to a 4-pole connector joint part (socket) of the electronic device, the electronic device may measure the impedance and voltage of the wired audio output device through a circuit connected to the connector joint part. Also, the electronic device may identify the type of the wired audio output device (e.g., a balanced type, an unbalanced type) based on the measured impedance and voltage, and then change the circuit configuration thereof based on the identified type of the wired audio output device. Through this change of the circuit configuration, the electronic device may support both types of audio output.

Figure 2A:
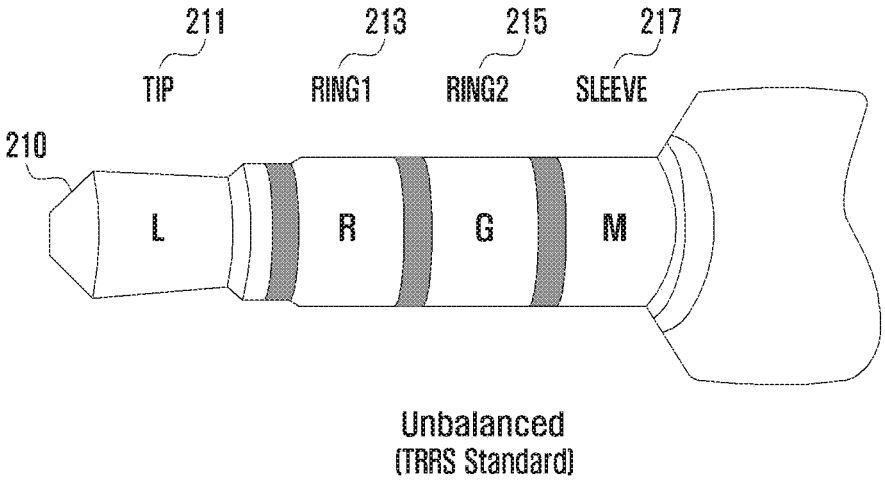
FIGS. 2A and 2B are diagrams illustrating an unbalanced type connector and a balanced type connector according to various embodiments of the present disclosure.
Figure 2B:
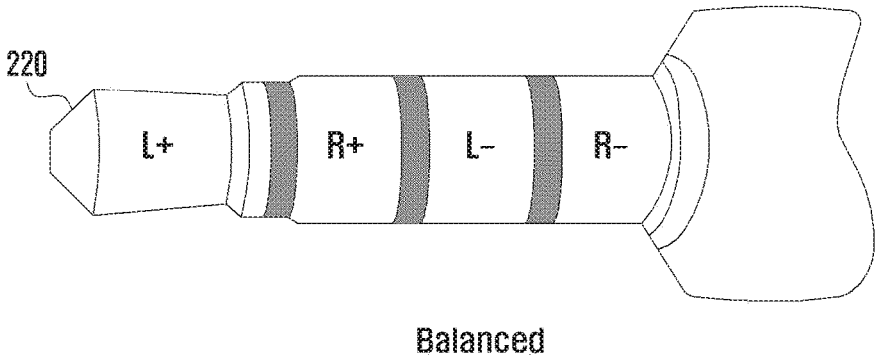

FIGS. 2A and 2B are diagrams illustrating an unbalanced type connector and a balanced type connector according to various embodiments of the present disclosure.

Referring to FIG. 2A, shown is a 4-pole connector 210 of unbalanced type. Normally, a connector may be formed of 3-pole, 4-pole, or 5-pole, and FIG. 2A shows the unbalanced type 4-pole connector 210. The 4-pole connector is formed of four terminals and may use a TIP, RING1, RING2, and SLEEVE (TRRS) type. The unbalanced type 4-pole connector 210 is designated as standard. The TRRS type may have a difference in terminal configuration between American standard (the order of left, right, ground, microphone (LRGM)) and European standard (the order of left, right, microphone, ground (LRMG)). Although this disclosure basically uses the TRRS type according to American standard (Cellular Telephone Industries Association (CTIA)/American headset jack (AHJ)), connectors according to various embodiments are not limited to American standard. The unbalanced type 4-pole connector 210, which is the TRRS type, may be configured to be coupled to L, R, G, and M signals in the order of being inserted into the electronic device. Namely, in the unbalanced type 4-pole connector 210, a TIP terminal 211 may be coupled to the L signal, and a RING1 terminal 213 may be coupled to the R signal. Also, a RING2 terminal 215 may be coupled to the G signal, and a SLEEVE terminal 217 may be coupled to the M signal. The unbalanced type 4-pole connector 210 shown in FIG. 2A may output the R signal and the L signal to an R output part and an L output part of the external output device, respectively, through a coder-decoder (codec) or a processor of the electronic device. Additionally, the unbalanced type 4-pole connector 210 coupled to a single GND signal and a single microphone (MIC) signal may allow a wired call.

Referring to FIG. 2B, shown is a 4-pole connector 220 of balanced type. The balanced type 4-pole connector 220 is not designated as standard and thus may have a difference in configuration of signals coupled to the TRRS type. For compatibility with the unbalanced type 4-pole connector 210, the 4-pole connector 220 shown in FIG. 2B is configured to be coupled to L+(a TIP terminal 211), R+(a RING1 terminal 213), L− (a RING2 terminal 215), and R− (a SLEEVE terminal 217) signals. The balanced type 4-pole connector may divide an audio signal into a plus signal and a minus signal, having different phases, and then transmit them. Additionally, the balanced type connector may be formed of 5-pole, not 4-pole, and be connected to the G signal.

Figure 3:
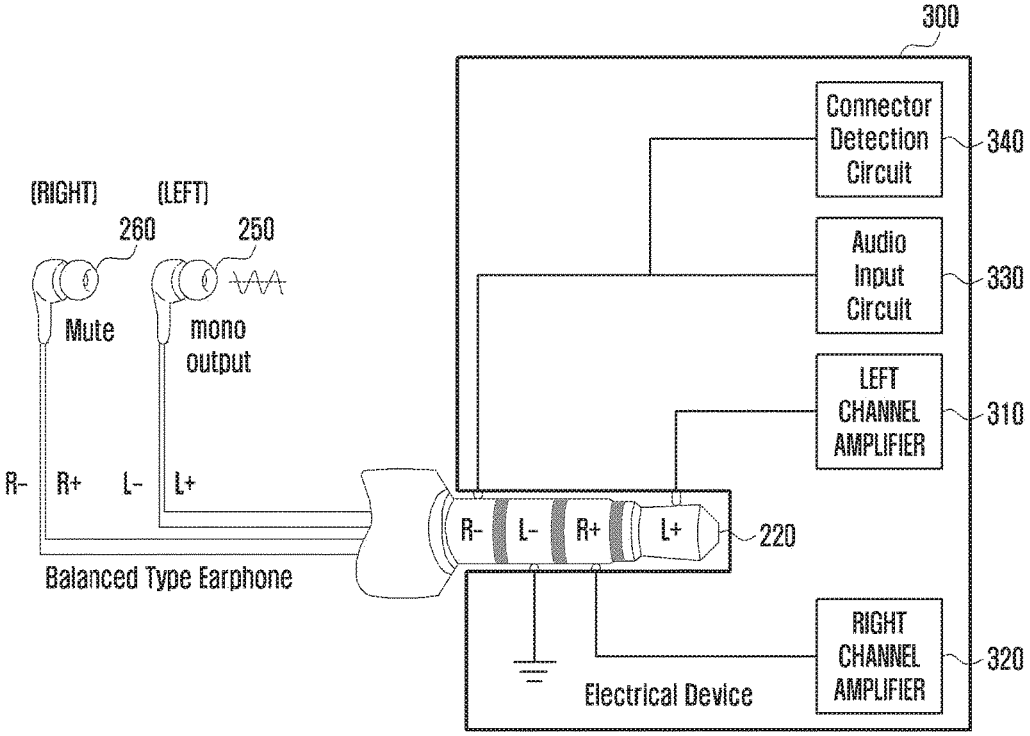
FIG. 3 is a diagram illustrating an audio output process in case a balanced type 4-pole connector is connected to an electronic device for supporting an unbalanced type according to various embodiments of the present disclosure.

FIG. 3 is a diagram illustrating an audio output process in case a balanced type 4-pole connector is connected to an electronic device for supporting an unbalanced type according to various embodiments of the present disclosure.

Referring to FIG. 3, the electronic device 300 supports an unbalanced type. Namely, the electronic device 300 has a circuit corresponding to LRGM signals of unbalanced type. For example, the TIP terminal is connected to a left channel amplifier 310, and the RING1 terminal is connected to a right channel amplifier 320. Also, the RING2 terminal is connected to the GND, and the SLEEVE terminal is connected to both an audio input circuit 330 and a connector detection circuit 340. Although the electronic device 300 has a circuit for supporting an unbalanced type LRGM connector, the balanced type 4-pole connector 220 is connected to the electronic device 300 as shown in FIG. 3. In this case, a signal flow is as follows.

According to various embodiments, the balanced type 4-pole connector 220 may have the terminal configuration in the order of L+, R+, L− and R−. The electronic device 300 may transmit an audio signal (e.g., the L audio signal) to the TIP terminal through the left channel amplifier 310. The connector connected to the TIP terminal receives the L audio signal, as L+, and transmits the L audio signal to a left earphone 250. The L audio signal passing the left earphone 250 is transmitted to the RING2 terminal corresponding to L−, and the RING2 terminal is connected to the GND. Namely, the L audio signal transmitted to the left earphone 250 may be outputted through the left earphone 250. Additionally, the electronic device 300 may transmit an audio signal (e.g., the R audio signal) to the RING1 terminal through the right channel amplifier 320. The connector connected to the RING1 terminal receives the R audio signal, as R+, and transmits the R audio signal to a right earphone 260. The R audio signal passing the right earphone 260 is transmitted to the SLEEVE terminal corresponding to R−, and the SLEEVE terminal is connected to both the audio input circuit 330 and the connector detection circuit 340. Namely, the R audio signal flows to the audio input circuit 330, and the right earphone 260 fails to output the R audio signal. Namely, the right earphone 260 is placed in a mute state. Therefore, when the balanced type 4-pole connector 220 is connected, the electronic device 300 supporting an unbalanced type cannot support the balanced type 4-pole connector 220. Even if a 4-pole connector having any configuration other than configuration of L+, R+, L− and R− shown in FIG. 3 is connected, the electronic device 300 may fail to completely support the balanced type 4-pole connector 220.

Figure 4:
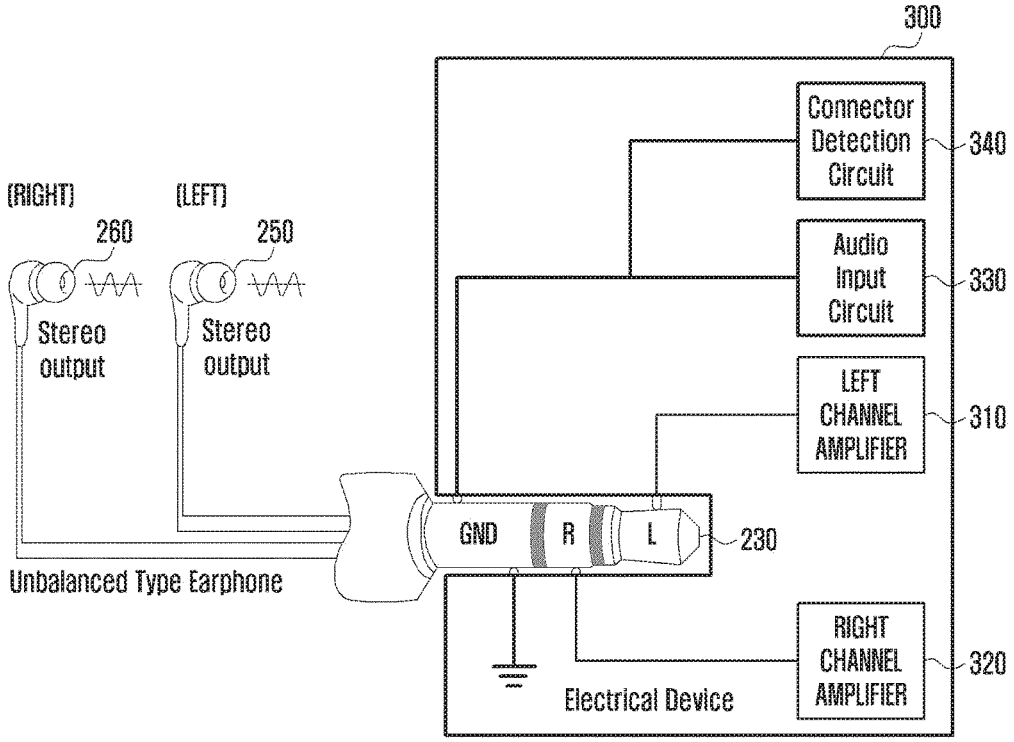
FIG. 4 is a diagram illustrating an audio output process in case a balanced type 3-pole earphone is connected to an electronic device for supporting an unbalanced type according to various embodiments of the present disclosure.

FIG. 4 is a diagram illustrating an audio output process in case a balanced type 3-pole earphone is connected to an electronic device for supporting an unbalanced type according to various embodiments of the present disclosure.

Referring to FIG. 4, the electronic device 300 is the same as discussed in FIG. 3, and a connector connected thereto is an unbalanced type 3-pole connector 230. In this case, a signal flow is as follows.

The unbalanced type 3-pole connector 230 may have the terminal configuration in the order of L, R and GND. Compared with the 4-pole connector, the unbalanced type 3-pole connector 230 has a single terminal corresponding to a combination of the RING2 terminal and the SLEEVE terminal. Namely, the 3-pole connector is formed of the TIP terminal, the RING terminal, and the SLEEVE terminal corresponding to both the RING2 terminal and the SLEEVE terminal of the 4-pole connector. In other words, the GND of the unbalanced type 3-pole connector 230 may be connected to both the RING2 terminal and the SLEEVE terminal of the electronic device 300.

The electronic device 300 may transmit an audio signal (e.g., the L audio signal) to the TIP terminal through the left channel amplifier 310. The L audio signal passes the left earphone 250 and is transmitted to the GND. Since the GND of the unbalanced type 3-pole connector 230 is connected to the GND of the electronic device 300, the L audio signal may be outputted through the left earphone 250. Also, the electronic device 300 may transmit an audio signal (e.g., the R audio signal) to the RING1 terminal through the right channel amplifier 320. The R audio signal passes the right earphone 260 and is transmitted to the GND. Since the GND of the unbalanced type 3-pole connector 230 is connected to the GND of the electronic device 300, the R audio signal may be outputted through the right earphone 260. When the unbalanced type 3-pole connector 230 is connected, the electronic device 300 according to various embodiments may not output a high-quality balanced audio signal (e.g., voice) to the earphone, but may output a low-quality unbalanced audio signal. Namely, in case the unbalanced type 3-pole connector is connected, the electronic device 300 may output an audio signal (e.g., voice) divided into the L audio signal and the R audio signal.

Figure 5:
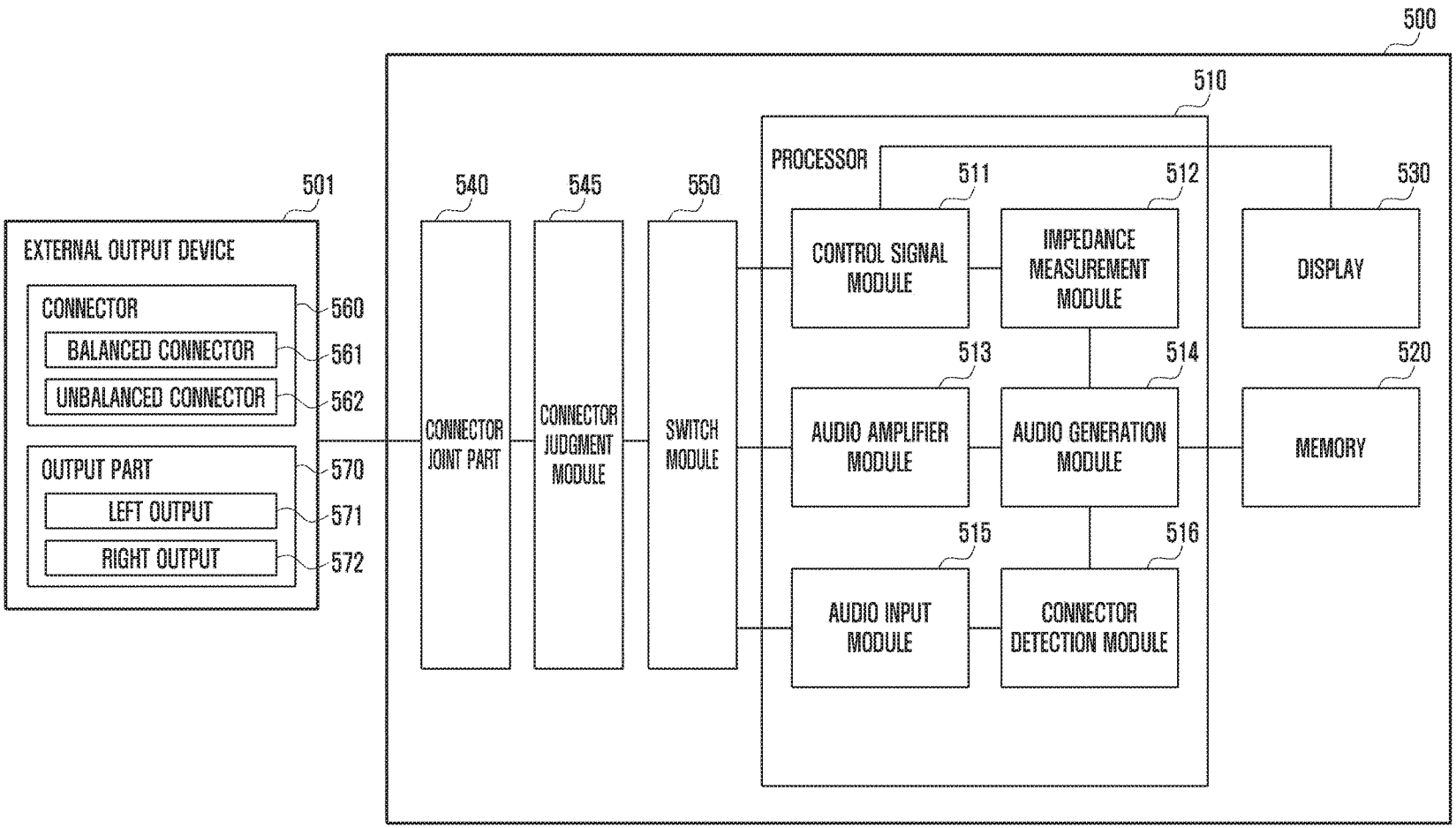
FIG. 5 is a block diagram of an electronic device according to various embodiments of the present disclosure.

FIG. 5 is a block diagram of an electronic device according to various embodiments of the present disclosure.

Referring to FIG. 5, the electronic device 500 may include a processor 510, a memory 520, a display 530, a connector joint part 540, a connector judgment module 545, and a switch module 550. The electronic device 500 may be connected to an external output device (e.g., an earphone, a headset) 501 through the connector joint part 540.

Although not shown, the above-mentioned elements are connected to each other via a bus, and the processor 510 may control such elements (e.g., the memory 520, the display 530, the connector joint part 540, and the switch module 550) by delivering a signal (e.g., a control message) to the elements.

The processor 510 may control the overall operation of the electronic device 500. For example, the processor 510 may receive a response from the aforesaid other elements (e.g., the memory 520, the display 530, the connector joint part 540, and the switch module 550) through the bus, decode the received response, and perform operation or data processing according to the decoded response. Although not shown, the processor 510 may include an application processor (AP) and a codec, and the AP may perform data processing based on the codec.

The processor 510 may include a control signal module 511, an impedance measurement module 512, an audio amplifier module 513, an audio generation module 514, an audio input module 515, and a connector detection module 516. The control signal module 511 may control signals with other modules. For example, when the insertion of a connector is detected through the connector detection module 516, the control signal module 511 may control the impedance measurement module 512 so as to identify the configuration of the inserted connector. Then, based on the identified configuration of the connector, the control signal module 511 may control the switch module 550.

The impedance measurement module 512 may measure the impedance of the external output device. For example, if the external output device is an earphone, the impedance measurement module 512 may measure impedance with regard to the left earphone (i.e., L impedance) and impedance with regard to the right earphone (i.e., R impedance). Namely, the impedance measurement module 512 may measure an impedance value with regard to a signal being transmitted through the TIP terminal and the RING1 terminal among 4-pole terminals of the electronic device 500. Since unbalanced 4-pole terminals are configured in the order of LRGM, the impedance measurement module 512 measures an impedance value regarding a signal being transmitted through L and R. In this case, an impedance value may be measured differently depending on the order of connector terminals formed in the external output device. The processor 510 may identify the configuration of connector terminals of the external output device, based on L and R impedance values measured by the impedance measurement module 512. Although the impedance measurement module 512 is shown as being mounted in the processor 510, this is not to be considered as a limitation. Alternatively, for example, the impedance measurement module 512 may be contained in the connector judgment module 545 and, when the external output device 501 is connected, may actively measure an impedance value of the external output device 501.

The audio amplifier module 513 may amplify an audio signal. Specifically, the audio amplifier module 513 may amplify the amplitude of an audio signal. For example, the audio amplifier module 513 may receive an L signal and an R signal, having analog waveforms, from the audio generation module 514 and then amplify the received L and R signals. Also, the audio amplifier module 513 may transmit the amplified L and R signals to the external output device.

The audio generation module 514 may convert a digital sound source, transmitted from the memory 520, into an analog waveform. Additionally, the audio generation module 514 may invert the phase of an audio signal converted into an analog waveform and thereby divide the audio signal into differential signals. Namely, the audio generation module 514 may divide the audio signal into the L signal and the R signal.

The audio input module 515 may receive an audio (voice) signal inputted from the external output device through the SLEEVE terminal among terminals of a 4-pole connector. The unbalanced type 4-pole connector may be formed of LRGM according to standard, and the M signal may be coupled to the SLEEVE terminal. Namely, the audio input module 515 may receive an audio (voice) signal, received from a MIC of the external output device (e.g., an earphone, a headset), through the SLEEVE terminal of the 4-pole connector.

The connector detection module 516 may detect whether the external output device 501 is connected to the connector joint part 540. For example, if the external output device 501 is connected, the connector detection module 516 may measure a change in voltage and thereby detect whether a connector 560 of the external output device 501 is connected or not. Additionally, based on such a change in voltage, the connector detection module 516 may identify whether the connector 560 of the external output device 501 is an unbalanced type or a balanced type. If the connector 560 is a balanced type, the connector detection module 516 may also check the configuration of terminals of the connector, i.e., the order of terminals. Although the connector detection module 516 is shown as being embedded in the processor 510, this is not to be considered as a limitation. Alternatively, the connector detection module 516 may be contained in the connector judgment module 545. In this case, when the external output device 501 is connected, the connector detection module 516 may detect the connection immediately and deliver detection information to the connector judgment module 545.

The memory 520 may store a multimedia file (e.g., a music file, an image file, etc.). The multimedia file may include a video file, a music file, or the like which has a sound source. The memory 520 may include an external memory and an internal memory and may refer to all kinds of storage units capable of storing multimedia files. The internal memory may be a memory unit (e.g., read only memory (ROM), NAND, random access memory (RAM), etc.) for temporarily or permanently storing streaming files and downloaded files. For example, the internal memory may include at least one of a volatile memory (e.g., dynamic RAM (DRAM), static RAM (SRAM), synchronous DRAM (SDRAM), etc.) and a nonvolatile memory (e.g., one time programmable ROM (OTPROM), PROM, erasable PROM (EPROM), electrically erasable PROM (EEPROM), mask ROM, flash ROM, NAND flash memory, NOR flash memory, etc.). Also, the external memory may be a memory unit (e.g., T-flash, multimedia card (MMC), secure digital (SD) card, etc.) which can be inserted into the electronic device. For example, the external memory may include flash drive, compact flash (CF), SD, micro-SD, mini-SD, extreme digital (xD), or a memory stick. The external memory may be functionally coupled to the electronic device 500 through a variety of interfaces.

The display 530 may include a panel, a hologram device, or a projector. The panel may be, for example, a liquid crystal display (LCD), an active matrix organic light emitting diode (AMOLED), and the like. The panel may be implemented, for example, in a flexible, transparent, or wearable form, and may be designed as a single module with a touch panel. Namely, the display 530 may display a video, an image, and the like, and may also recognize a user's touch input. For example, the touch panel may detect a touch input in a capacitive, pressure, infrared, or ultrasonic manner. The display 530 according to various embodiments may receive a user input for identifying left and right output parts of the external output device. For example, the electronic device 500 may output a signal sound to one of the left and right output parts and instruct a user to select a specific output part from which the signal sound is heard. The electronic device 500 may display, through the display 530, a pop-up message for allowing a user to select one of the left and right output parts and then receive, through the display 530, a user input on the pop-up message.

The connector joint part 540 is configured to connect the electronic device 500 to the external output device 501. The electronic device 500 may have the connector joint part 540 in a suitable form for the connection with the connector 506 of the external output device 501. The connector joint part 540 may be configured to transmit LRGM signals corresponding to the unbalanced 4-pole connector standard of the connector 506 of the external output device 501. The connector joint part 540 according to various embodiments may have a circuit for supporting the balanced type connector as well as the unbalanced type connector.

The connector judgment module 545 is configured to judge as to the connector 560 of the external output device 501 connected to the electronic device 500. For example, even though the processor 510 may directly judge the connector 560 of the external output device 501, the connector judgment module 545 may perform judgment and then deliver information about the connector 560 of the external output device 501 to the processor 510. The connector judgment module 545 may perform the functions of the impedance measurement module 512 and the connector detection module 516. Although not shown, the impedance measurement module 512 and the connector detection module 516 may be contained in the connector judgment module 545.

When the external output device 501 is connected to the electronic device 500, the connector judgment module 545 may determine the connection or not of the external output device 501. Also, the connector judgment module 545 may determine the type (e.g., a balanced type, an unbalanced type) of the connector 560 by transmitting an electric signal to the connector 560 of the external output device 501. And also, the connector judgment module 545 may determine whether the connector 560 is 3-pole or 4-pole, may check an impedance value as to the connector 560 on the basis of the transmitted electrical signal, and may identify the configuration of the connector 560. The connector judgment module 545 may be mounted on a position different from the processor 510 and perform a function to deliver information about the external output device 501 to the processor 510. The processor 510 of the electronic device 500 according to various embodiments may receive information about the external output device 501 from the connector judgment module 545 and, based on such information, may control the switch module 550.

The switch module 550 may include a switch contained in a circuit of the electronic device 500. The switch module 550 may include the switch located between the connector joint part 540 and the processor 510 and operate under the control of the control signal module 511. For example, when the external output device 501 is connected, the electronic device 500 may control the switch module 550, based on a voltage value measured through the connector detection module 516 and an impedance value measured through the impedance measurement module 512. The switch module 550 may drive the switch so as to allow a circuit, connected on the assumption that the external output device 501 is an unbalanced type, to correspond to a balanced type.

The electronic device 500 according to various embodiments may be connected to the external output device 501 and output an audio signal through the external output device 501.

The external output device 501 may receive an audio signal from the electronic device 500 and then output the received audio signal through an output part 570. For example, in case the external output device 501 is an earphone, the electronic device 500 may be connected to the connector of the earphone through the connector joint part 540. Also, the electronic device 500 may transmit an audio signal to the earphone such that the left and right output parts of the earphone can output the audio signal. Although the earphone is used hereinbefore as the external output device 501, this is not to be considered as a limitation.

The external output device 501 may include the connector 560 and the output part 570. The connector 560 may be a means of connecting with the electronic device 500 and receiving an audio signal from the electronic device 500. The connector 560 may be classified into a balanced connector 561 and an unbalanced connector 562, and the external output device 501 may include in general the unbalanced connector 562. The balanced type external output device 501, i.e., having the balanced connector 561, may output an audio signal with higher performance in comparison with the unbalanced type. Meanwhile, the output part 570 may output an audio signal and have a left output 571 and a right output 573.

The electronic device 500 according to various embodiments may detect the external output device 501 connected to the connector joint part 540 and identify the configuration of the connector 560 of the external output device 501. Also, based on the identified configuration of the connector 560, the electronic device 500 may control the switch module 550. Namely, using a circuit corresponding to the connector 560 of the external output device 501, the electronic device 500 may support the external output device 501.

Figure 6A:
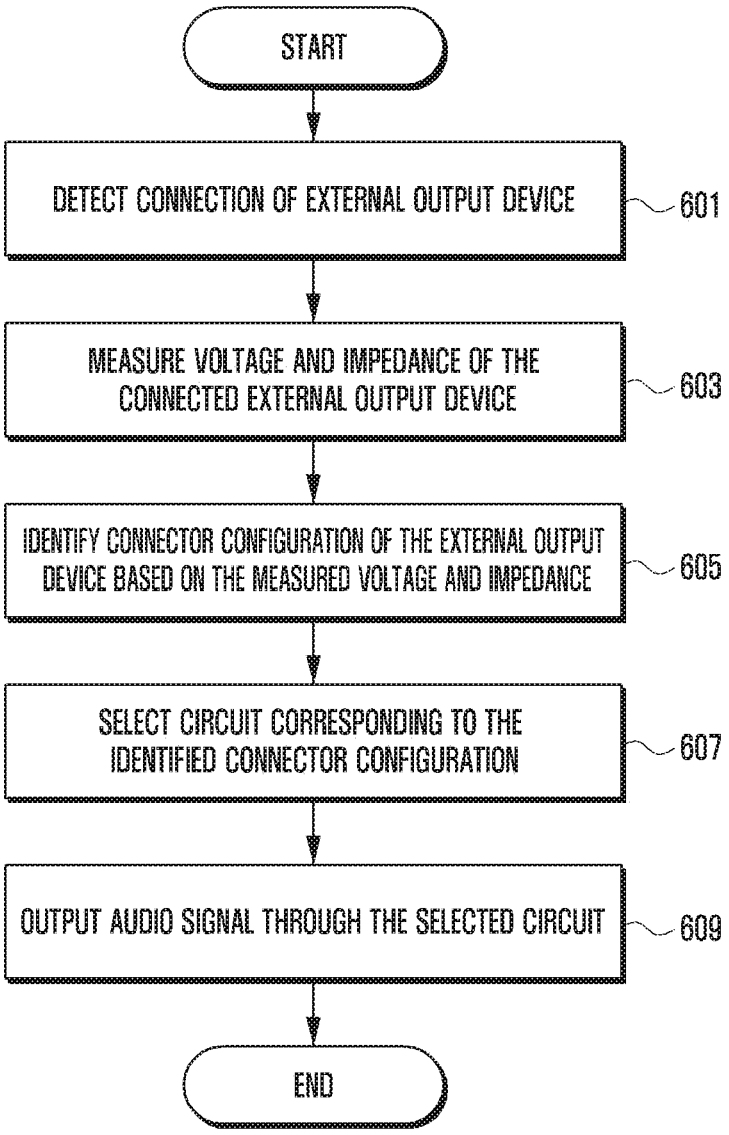
FIG. 6A is a flow diagram illustrating a method for outputting audio through a circuit determined on the basis of the configuration of a connector of a connected external output device after identifying the configuration of the connector according to various embodiments of the present disclosure.

FIG. 6A is a flow diagram illustrating a method for outputting audio through a circuit determined on the basis of the configuration of a connector of a connected external output device after identifying the configuration of the connector according to various embodiments of the present disclosure.

Referring to FIG. 6A, at operation 601, the electronic device 500 may detect the connection of the external output device 501. For example, when the external output device 501 is connected to the electronic device 500, the processor 510 of the electronic device 500 may detect the connection of the external output device 501 through the connector detection module 516. When the connector 560 of the external output device 501 is connected to the connector joint part 540 of the electronic device 500, the processor 510 of the electronic device 500 may detect the connection of the connector 560.

At operation 603, the processor 510 of the electronic device 500 may measure voltage and impedance with regard to the connected external output device 501. For example, the processor 510 may detect voltage with regard to the external output device 501 through the connector detection module 516 and measure impedance with regard to the external output device 501 through the impedance measurement module 512. This is, however, not to be considered as a limitation. The processor 510 may measure the voltage of the external output device 501, using a circuit corresponding to the SLEEVE terminal of the connector 560 through the connector detection module 516. Additionally, the processor 510 may measure impedance as to the left and right output parts of the external output device 501 through the impedance measurement module 512. Basically, the connector joint part 540 of the electronic device 500 may be connected to the L signal at the TIP terminal and to the R signal at the RING1 terminal so as to support the unbalanced type connector. Therefore, the impedance measurement module 512 may measure impedance as to the left output 571 through the TIP terminal and also measure impedance as to the right output 572 through the RING1 terminal.

At operation 605, the processor 510 may identify the configuration of the connector 560 of the external output device 501, based on the measured voltage and impedance. For example, the processor 510 may identify whether the external output device 501 is an unbalanced type or a balanced type. In case of the balanced type, the processor 510 according to various embodiments may also identify the terminal configuration of the connector 560 of the external output device 501. The electronic device 500 needs to identify the terminal configuration regarding the connector 560. The processor 510 may identify the terminal configuration of the connector 560, based on the measured voltage and impedance. Detailed description about operation 605 will be given below with reference to FIG. 6B.

At operation 607, the processor 510 may determine a circuit corresponding to the identified configuration of the connector 560. For example, the processor 510 may control the switch module 550 according to the configuration of the connector 560. The processor 510 may change a circuit configuration by controlling the switch module 550 and thereby support the balanced type external output device as well as the unbalanced type external output device.

At operation 609, the processor 510 may output an audio signal through the determined circuit. For example, in case the external output device 501 is a balanced type, the processor 510 may output an audio signal by distinguishing the left output 571 from the right output 573 in the output part 570. The processor 510 may generate audio from a video or audio file stored in the memory 520 through the audio generation module 514. Additionally, the processor 510 may amplify the generated audio through the audio amplifier module 513 and output the amplified audio through the determined circuit to the output part 570 of the external output device 501.

Figure 6B:
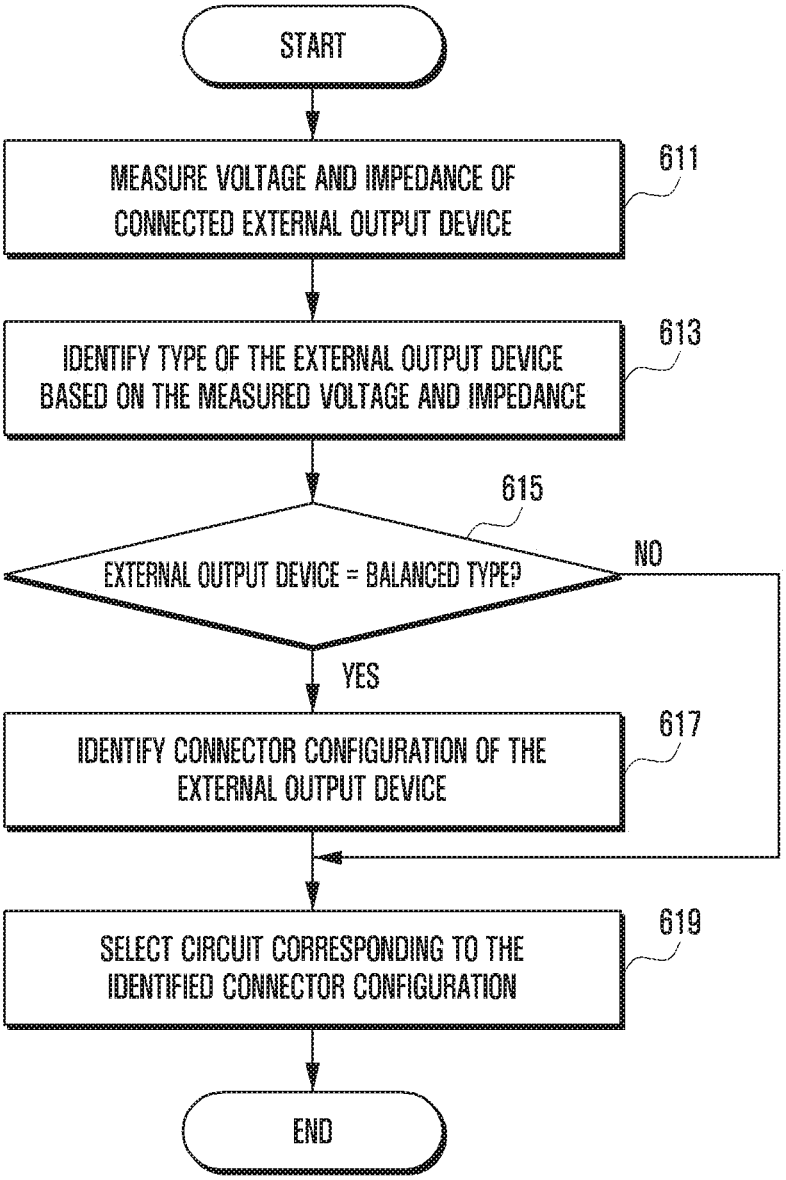
FIG. 6B is a flow diagram illustrating a method for identifying the type of a connected external output device and the configuration of a connector of the external output device according to various embodiments of the present disclosure.

FIG. 6B is a flow diagram illustrating a method for identifying the type of a connected external output device and the configuration of a connector of the external output device according to various embodiments of the present disclosure.

Referring to FIG. 6B, at operation 611, the processor 510 of the electronic device 500 may measure voltage and impedance with regard to the connected external output device. This operation 611 may be equivalent to the above discussed operation 603 in FIG. 6A. Therefore, detailed description about operation 611 will be omitted.

Operations 613 to 617 in FIG. 6B correspond to operation 605 in FIG. 6A. Namely, FIG. 6B shows a detailed flow of operation 605 in FIG. 6A. At operation 613, the processor 510 may identify the type of the external output device, based on the measured voltage and impedance. For example, based on the measured voltage and impedance, the processor 510 may determine whether the external output device 501 is an unbalanced type or a balanced type. Also, the processor 510 may further determine whether the external output device 501 is configured as a 3-pole connector or a 4-pole connector. At operation 615, the processor 510 may determine whether the external output device 501 is a balanced type. If the external output device 501 is a balanced type, the processor 510 may identify the connector configuration of the external output device at operation 617. Since the configuration of the balanced type connector may vary according to the external output device 501, the processor 510 needs to identify the connector configuration. Specifically, in case of a 4-pole connector, the configuration corresponding to the TIP terminal, the RING1 terminal, the RING2 terminal and the SLEEVE terminal may vary according to the external output device 501. Therefore, at operation 617, the processor 510 may identify the connector configuration of the external output device 501, based on the measured voltage and impedance. Depending on various embodiments, the processor 510 may further measure impedance at operation 617 so as to identify the connector configuration. Meanwhile, at operation 619, the processor 510 may select a circuit corresponding to the identified connector configuration. This operation 619 may be equivalent to the above discussed operation 607 in FIG. 6A. Therefore, detailed description about operation 619 will be omitted.

Figure 7:
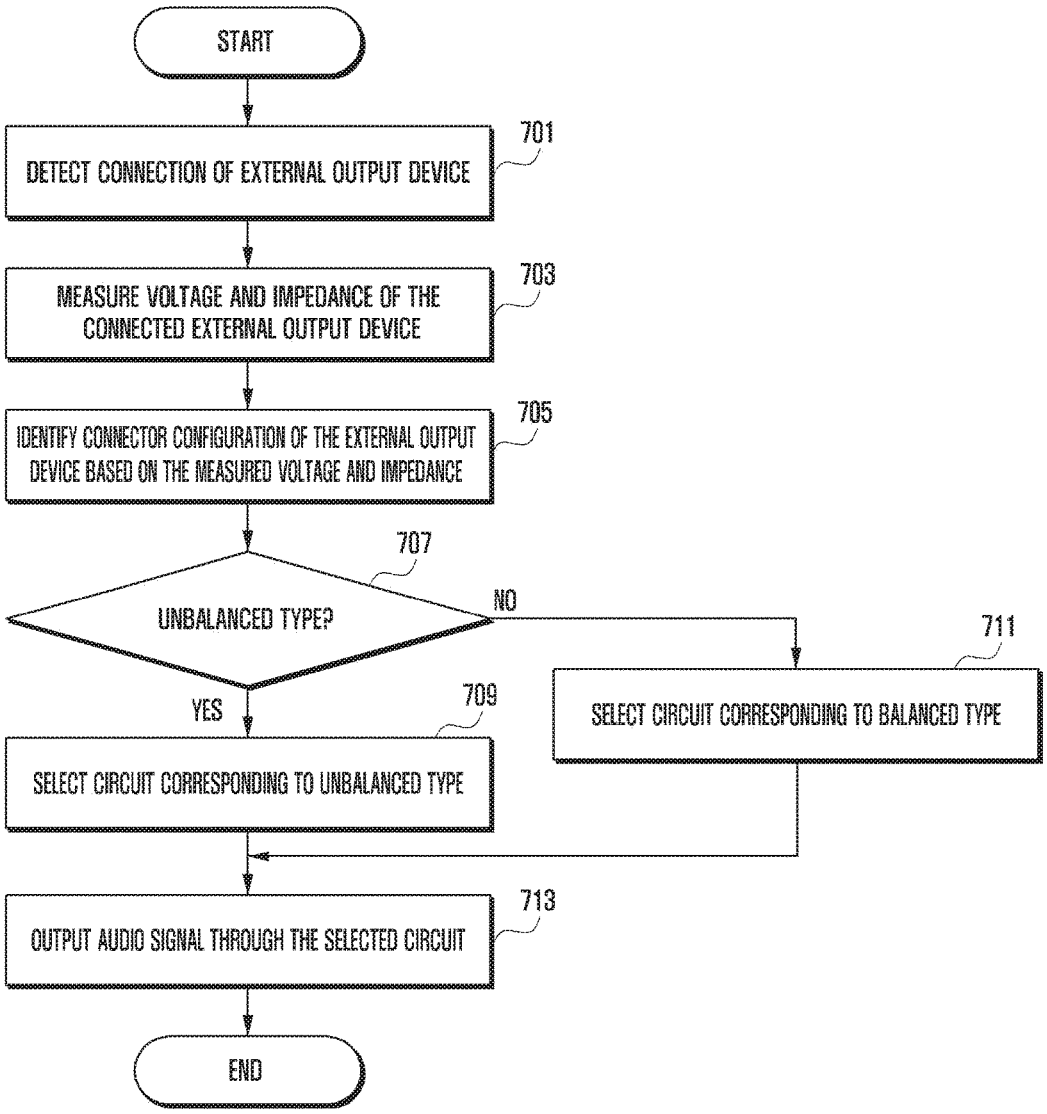
FIG. 7 is a flow diagram illustrating a method for determining a circuit depending on a balanced type or an unbalanced type of a connected external output device according to various embodiments of the present disclosure.

FIG. 7 is a flow diagram illustrating a method for determining a circuit depending on a balanced type or an unbalanced type of a connected external output device according to various embodiments of the present disclosure.

Referring to FIG. 7, operations 701 to 705 are equivalent to the above discussed operations 601 to 605 in FIG. 6A. At operation 707, the processor 510 of the electronic device 500 may identify whether the external output device 501 is an unbalanced type or a balanced type. According to various embodiments, the processor 510 may identify the type of the external output device 501, based on the measured impedance value. Specifically, the processor 510 may identify the type of the external output device 501, based on an impedance value (L-Imp) as to the left output of the external output device 501 and an impedance value (R-Imp) as to the right output of the external output device 501. According to various embodiments, the processor 510 may further identify the terminal configuration as to the connector 560 of the external output device 501 through an impedance value. According to an embodiment, the processor 510 may identify the type of the external output device 501, based on a voltage value measured at operation 703. According to an embodiment, the processor 510 may determine, based on the measured voltage value, whether the connector 560 of the external output device 501 is a 3-pole or a 4-pole, and further determine the type (i.e., balanced or unbalanced) of the external output device 501.

If it is determined at operation 707 that the external output device 501 is an unbalanced type, the processor 510 may determine a circuit corresponding to an unbalanced type at operation 709. For example, the processor 510 may determine a circuit corresponding to an unbalanced type by controlling the switch module 550. Since the electronic device 500 basically has a pre-established circuit for supporting an unbalanced type, the processor 510 may support the external output device 501 of unbalanced type with the pre-established circuit.

After determining the circuit corresponding to the unbalanced type at operation 709, the processor 510 may output an audio signal through the determined circuit at operation 713. Namely, the processor 510 may output the audio signal through the output part of the connected external output device.

If it is determined at operation 707 that the external output device 501 is a balanced type, the processor 510 may determine a circuit corresponding to a balanced type at operation 711. For example, the processor 510 may determine a circuit corresponding to a balanced type by controlling the switch module 550. The determined circuit may be a circuit pre-established on the basis of various balanced types. According to various embodiments, the processor 510 may further identify the terminal configuration as to the connector 560 of the external output device 501 through an impedance value.

Figure 8A:
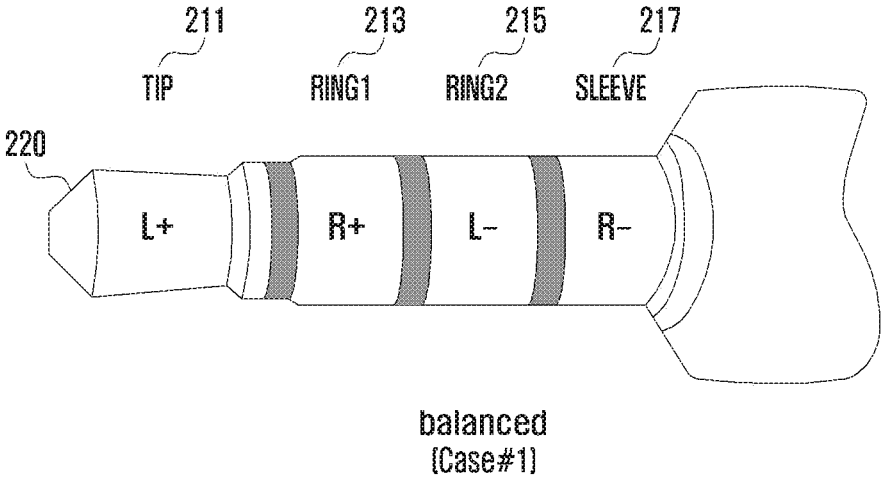
FIGS. 8A and 8B are diagrams illustrating a configuration of a balanced type connector considering compatibility with an unbalanced type connector according to various embodiments of the present disclosure.
Figure 8B:
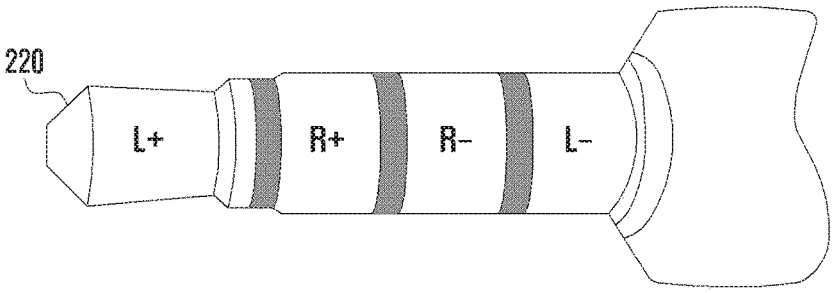

FIGS. 8A and 8B are diagrams illustrating the configuration of a balanced type connector considering compatibility with an unbalanced type connector according to various embodiments of the present disclosure.

Referring to FIG. 8A, shown is a balanced type connector (4-pole) 220. The balanced type connector 220 may have a plus (+) signal and a minus (−) signal as to an audio signal. The external output device 501 may output audio signals to left and right output parts, respectively. According to various embodiments, the balanced type connector 210 may be formed of L+, L−, R+ and R− signals. Meanwhile, an unbalanced type connector may have 4-pole terminals in the order of LRGM. The balanced type 4-pole connector 220 may be configured in the order of L+, R+, L− and R− such that the electronic device designed for an unbalanced type can easily support the balanced type 4-pole connector 220. Namely, the balanced type 4-pole connector 220 shown in FIG. 8A may be configured as the TIP terminal 211 of L+, the RING1 terminal 213 of R+, the RING2 terminal 215 of L−, and the SLEEVE terminal 217 of R−. The balanced type 4-pole connector 220 in FIG. 8A is different from the unbalanced type connector 210 in configuration of the RING2 terminal 215 and the SLEEVE terminal 217.

Referring to FIG. 8B, shown is another balanced type connector (4-pole) 220. Contrary to FIG. 8A, the balanced type 4-pole connector 220 shown in FIG. 8B may be configured as the RING2 terminal 215 of R− and the SLEEVE terminal 217 of L−. The balanced type 4-pole connector 220 in FIG. 8B as well is different from the unbalanced type connector 210 in configuration of the RING2 terminal 215 and the SLEEVE terminal 217.

In case the external output device 501 having the balanced type 4-pole connector 220 (i.e., a balanced type connector considering compatibility) as shown in FIG. 8A or 8B is connected, the processor 510 of the electronic device 500 may support the external output device 501 through a circuit change using the switch module 550.

Figure 9:
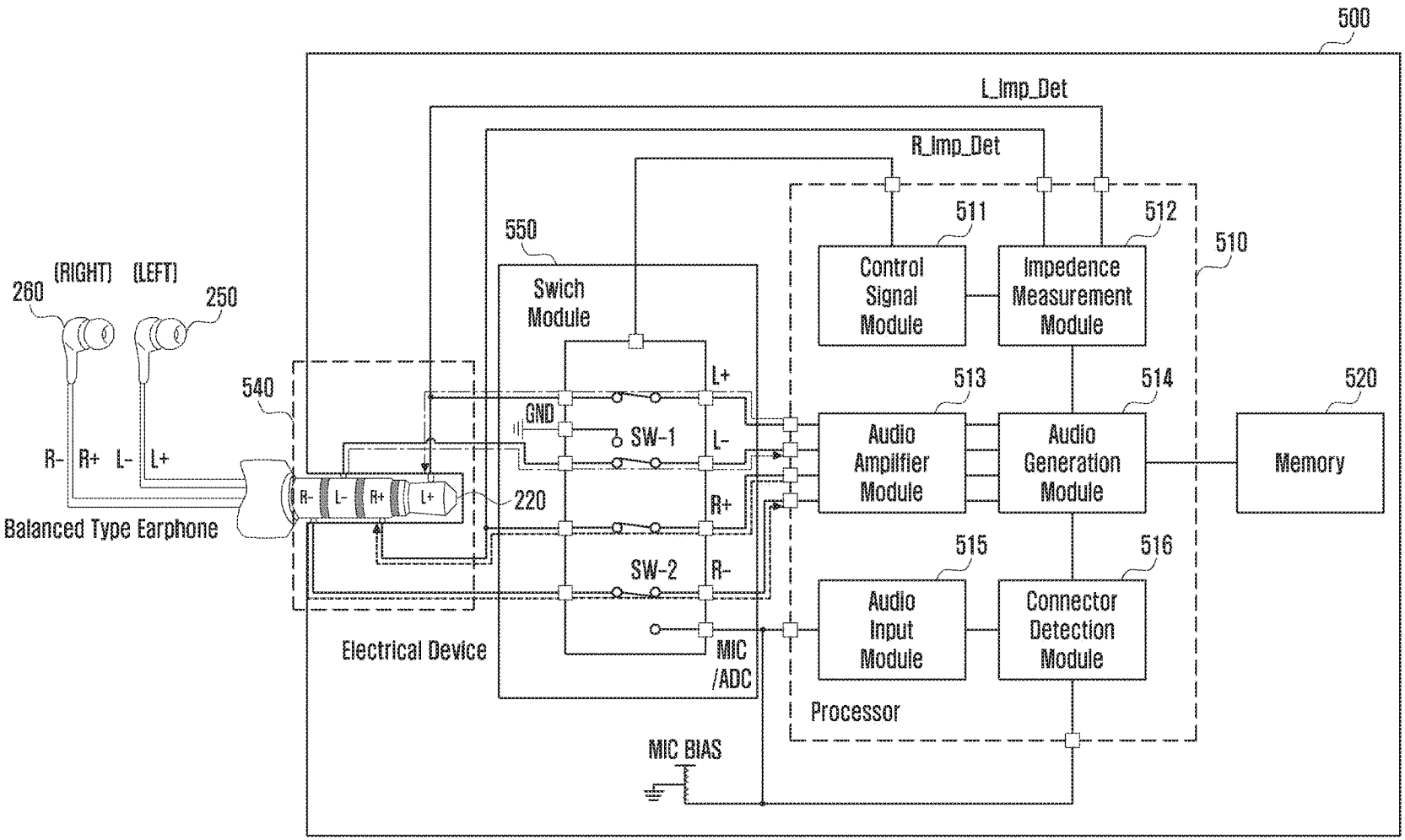
FIG. 9 is a diagram illustrating operation of an electronic device when a balanced type output device is connected to the electronic device according to various embodiments of the present disclosure.

FIG. 9 is a diagram illustrating the operation of an electronic device when a balanced type output device is connected to the electronic device according to various embodiments of the present disclosure.

Referring to FIG. 9, the electronic device 500 may be placed in a state where a balanced type earphone (i.e., an output device) is connected through the connector joint part 540. The balanced type earphone has a left earphone 250 and a right earphone 260 and may be connected to the electronic device 500 through the 4-pole balanced type connector 220. When the balanced type 4-pole connector 220 is connected, the processor 510 of the electronic device 500 may detect the connection of the balanced type 4-pole connector 220 through the connector detection module 516. According to various embodiments, the connector detection module 516 may detect a change in voltage caused by the insertion of the earphone. Additionally, the processor 510 may identify the terminal configuration of the balanced type 4-pole connector 220 through the impedance measurement module 512. The processor 510 may store the value of the changed voltage and the impedance value in an internal buffer or RAM and, based on the stored values, may identify the terminal configuration of the balanced type 4-pole connector 220. Description about impedance measured by the impedance measurement module 512 will be given below with reference to FIG. 10. After identifying the terminal configuration of the balanced type 4-pole connector 220, the processor 510 may control the switch module 550 through the control signal module 511. The processor 510 may change a circuit to meet the terminal configuration of the balanced type 4-pole connector 220. Then, using the audio generation module 514 and the audio amplifier module 513, the processor 510 may transmit an audio signal to the balanced type earphone through the changed circuit. Namely, the processor 510 of the electronic device 500 may support a balanced type output device considering compatibility as well as an unbalanced type output device.

Figure 10:
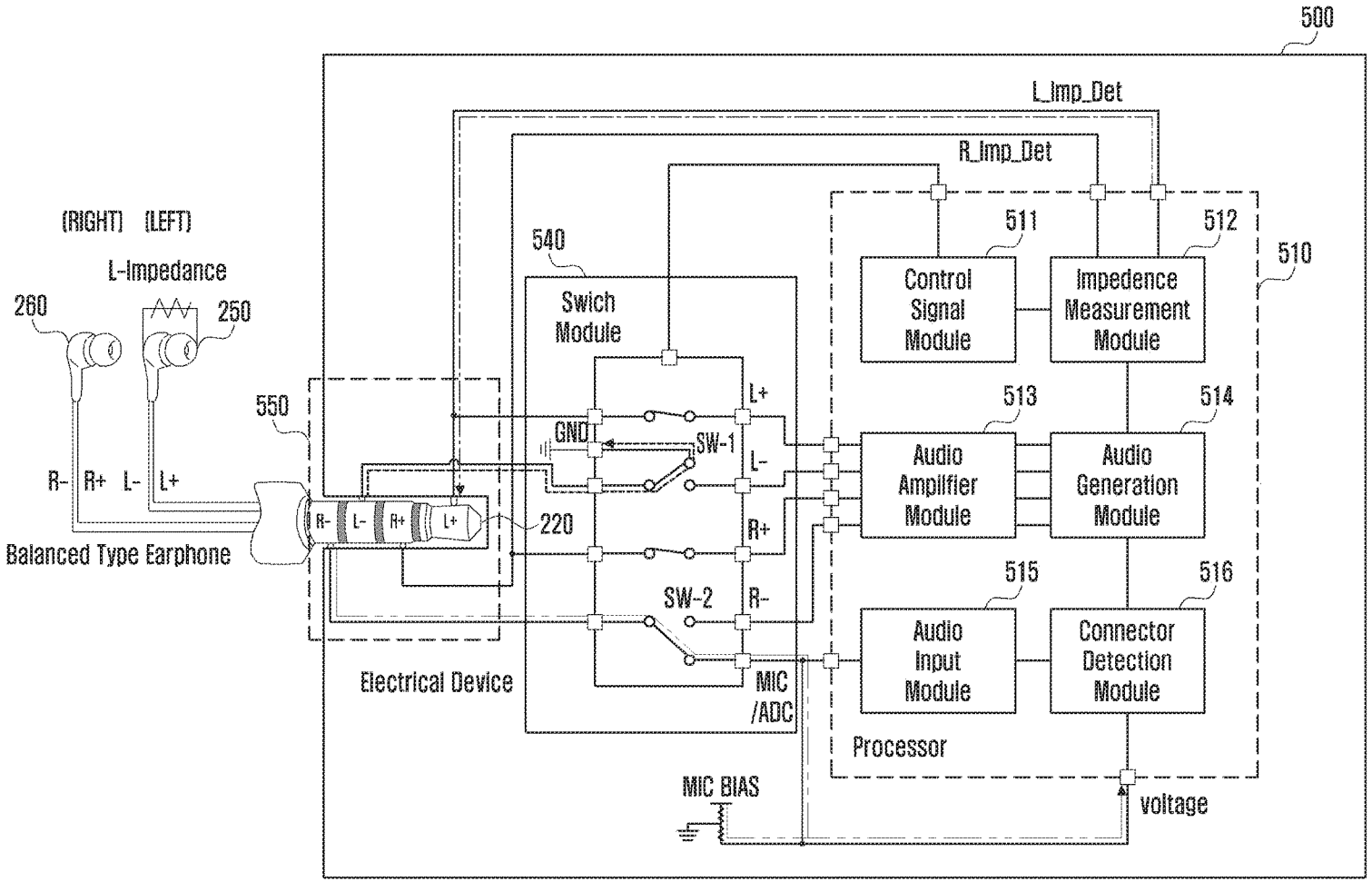
FIG. 10 is a diagram illustrating operation of an electronic device for measuring impedance and voltage with regard to an output device when a balanced type output device is connected to the electronic device according to various embodiments of the present disclosure.

FIG. 10 is a diagram illustrating the operation of an electronic device for measuring impedance and voltage with regard to an output device when a balanced type output device is connected to the electronic device according to various embodiments of the present disclosure.

Referring to FIG. 10, the processor 510 of the electronic device 500 may detect the connection of a balanced type earphone through the connector detection module 516. Also, in order to identify the terminal configuration of the balanced type earphone, the processor 510 may measure impedance and voltage of the balanced type earphone. For example, the impedance of the left earphone 250 of the balanced type earphone may be measured. This is, however, not to be considered as a limitation.

In order to measure the impedance as to the balanced type earphone, the processor 510 may supply a minute electric current to the balanced type earphone by controlling the impedance measurement module 512. This minute electric current may be supplied to the left output part 250 of the earphone through the balanced type 4-pole connector 220. Then the minute electric current returns to the pre-established circuit through the switch module 550. In this case, the processor 510 may pre-establish a suitable circuit for measurement of impedance by controlling the switch module 550. Through the above process, the processor 510 may measure impedance as to the left output part 250 of the earphone (i.e., L-Imp). Additionally, through the connector detection module 516, the processor 510 may measure a change in voltage depending on the connection of the balanced type earphone. Table 1 given below shows impedance values and voltage values which are measured differently depending on the connector configuration of the external output device connected to the electronic device 500.

TABLE 1

| Earphone (L, R, G, M) | L-Imp | R-Imp | Analog-to-Digital (ADC) Level (MIC Bias) |
|---|---|---|---|
| Normal 3-pole | Several Ω~Hundreds Ω | Several Ω~Hundreds Ω | 0 V |
| Normal 4-pole | Several Ω~Hundreds Ω | Several Ω~Hundreds Ω | 2 V~2.4 V |
| Balanced 4-pole (L+, R+, L−, R−) | Several Ω~Hundreds Ω | Open | More than 2.7 V |
| Balanced 4-pole (L+, R+, R−, L−) | Open | Several Ω~Hundreds Ω | More than 2.7 V |
| Balanced 4-pole (L+, L−, R+, R−) | Open | Open | 0.05 V~0.3 V |
| Balanced 4-pole (R+, R−, L+, L−) | Open | Open | 0.05 V~0.3 V |

Referring to Table 1, if the external output device connected to the electronic device 500 is formed of a normal 3-pole connector (i.e., unbalanced type 3-pole connector), each of L-Imp (the impedance of the left output part) and R-Imp (the impedance of the right output part) may be measured from several Ω to hundreds Ω. Also, the voltage measured at the normal 3-pole connector may be 0 V.

If the external output device connected to the electronic device 500 is formed of a balanced type 4-pole connector (L+, R+, L−, and R−), L-Imp (the impedance of the left output part) may be measured from several Ω to hundreds Ω and R-Imp (the impedance of the right output part) may be measured as an open state which may mean that a supplied electrical current flows out through a MIC. Also, the voltage measured at the balanced type 4-pole connector (L+, R+, L−, and R−) may be 2.7 V.

If the external output device connected to the electronic device 500 is formed of a balanced type 4-pole connector (L+, L−, R+, and R−), each of L-Imp (the impedance of the left output part) and R-Imp (the impedance of the right output part) may be measured as an open state. Also, the voltage measured at the balanced type 4-pole connector (L+, L−, R+, and R−) may be from 0.05 V to 0.3 V.

As discussed above, the processor 510 of the electronic device 500 may identify the configuration of the connector of the external output device, based on values of impedance and voltage as to the left and right output parts of the external output device. Values shown in Table 1 were measured through experiments, and not to be considered as a limitation. For example, although Table 1 shows impedance values from several Ω to hundreds Ω, impedance values may be measured differently depending on kinds of wired audio output devices. Particularly, the impedance value of earphone may be varied according to manufacturers. Table 2 shows measured impedance values in case of some manufacturers.

TABLE 2

| Manufacturer | Samsung | Apple | LG (Quadbeat2) | Sony (MDR-ZX750AP) | Sennheiser (HD800) |
|---|---|---|---|---|---|
| Impedance | 32 Ω | 32 Ω | 24 Ω | 40 Ω | 300 Ω |

Even though measured impedance values is varied depending on manufacturers or kinds of output devices, the processor 510 may identify the connector configuration of the output device on the basis of impedance values and voltage values as to the output device.

According to various embodiments, it may be difficult to distinguish the left output part from the right output part in case of one balanced type 4-pole connector (L+, L−, R+, R−) and another balanced type 4-pole connector (R+, R−, L+, L−). In this case, the processor 510 may request a user to make a decision about left and right. For example, the processor 510 may output a specific signal sound through one of the left and right output parts and also display a related notification window (e.g., a pop-up message) on the display 530. Then the processor 510 may receive a user input and thereby distinguish the left output part from the right output part. Displaying the notification window is not to be considered as a limitation. Alternatively, for example, a certain sensor equipped in the output device may be utilized for determining the output part.

Figure 11:
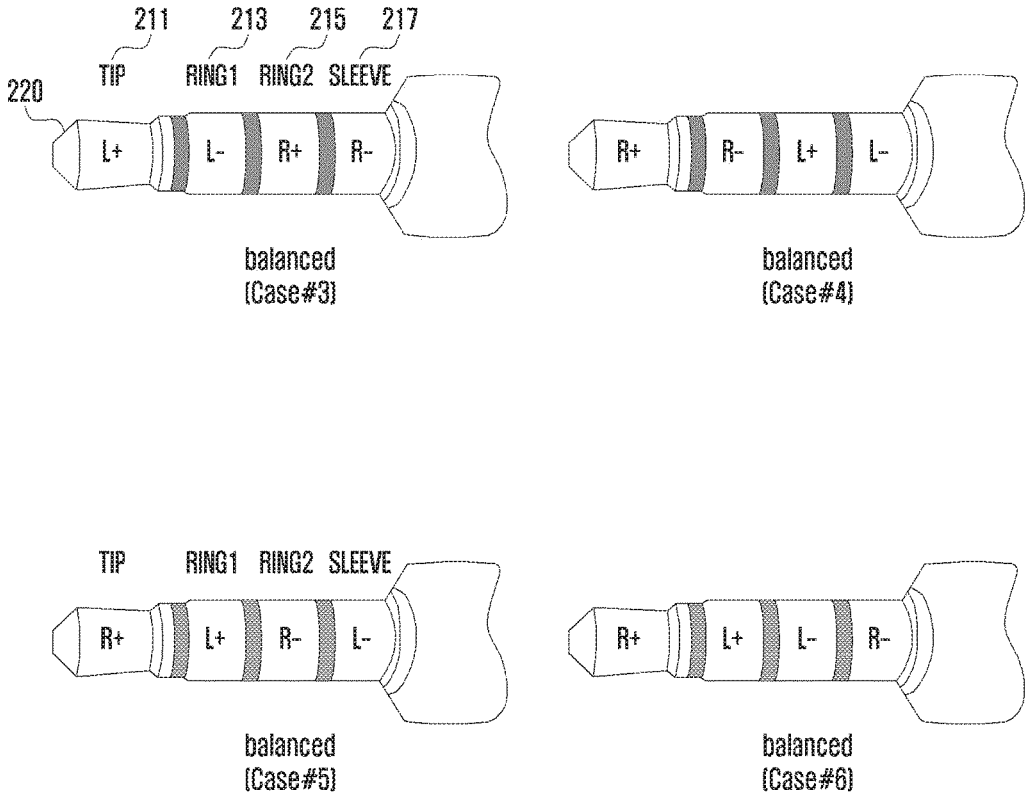
FIG. 11 is a diagram illustrating a variety of balanced type output devices according to various embodiments of the present disclosure.

FIG. 11 is a diagram illustrating a variety of balanced type output devices according to various embodiments of the present disclosure.

Referring to FIG. 11, there may be some kinds of configurations in the connector of the external output device. According to various embodiments, the balanced type 4-pole connectors 220 (herein, referred to as cases 1 and 2) as shown in FIGS. 8A and 8B have the TIP terminal of L+ and the RING1 terminal of R+. Namely, these balanced type 4-pole connectors 220 (cases 1 and 2) may have the connector configuration considering compatibility of an unbalanced type connector. Besides, the balanced type 4-pole connector 220 may be configured in the order of L+, L−, R+ and R− (case 3), in the order of R+, R−, L+ and L− (case 4), in the order of R+, L+, R− and L− (case 5), or in the order of R+, L+, L− and R− (case 6). This order represents the order of the TIP terminal 211, the RING1 terminal 213, the RING2 terminal 215 and the SLEEVE terminal 217. Six cases of the connector of the external output device are not to be considered as a limitation.

Figure 12:
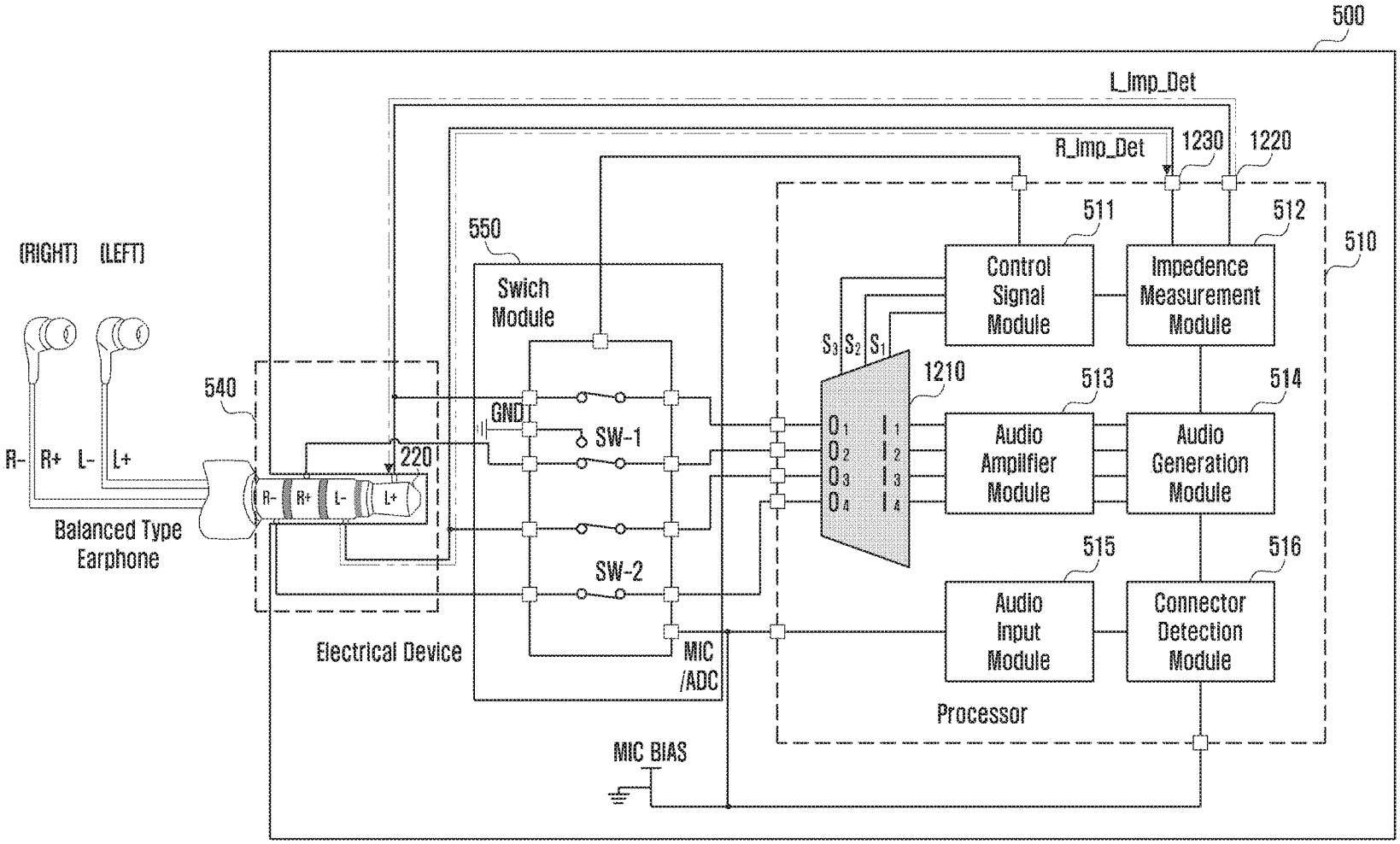
FIG. 12 is a diagram illustrating operation of an electronic device when one of a variety of balanced type output devices is connected to the electronic device according to various embodiments of the present disclosure.

FIG. 12 is a diagram illustrating the operation of an electronic device when one of a variety of balanced type output devices is connected to the electronic device according to various embodiments of the present disclosure.

Referring to FIG. 12, the electronic device 500 may be placed in a state where a balanced type earphone (output device) is connected through the connector joint part 540. In this case, the balanced type connector may be configured in the order of L+, L−, R+ and R−. The processor 510 of the electronic device 500 may measure an impedance value as to the balanced type earphone through the impedance measurement module 512. For example, the processor 510 may measure the L-Imp value as to the left output part. The processor 510 may supply a current through an L-Imp supply terminal 1220. Since the balanced type connector is configured in the order of L+, L−, R+ and R−, the current supplied through the L-Imp supply terminal 1220 by the processor 510 may flow in through the TIP terminal 211 and then flow out through the RING1 terminal 213. At this time, the RING1 terminal 213 may be placed in a state of being connected to an R-Imp supply terminal 1230 of the impedance measurement module 512. Namely, the L-Imp value of the left output part may be measured as open, and similarly the R-Imp value of the right output part may be measured as open. Based on such measured values, the processor 510 may identify that the TIP terminal 211 and the RING1 terminal 213 are formed of the same output part.

Meanwhile, the processor 510 of the electronic device 500 may control the switch module 550 by controlling the control signal module 511. Additionally, the electronic device 500 may transmit an audio signal of a specific output part (e.g., the left output part or the right output part) through the TIP terminal 211, and add a multiplexer (MUX) circuit 1210 so as to receive the audio signal through the RING1 terminal 213. The MUX circuit 1210 may be disposed inside or outside the processor 510. The MUX circuit 1210 may be interposed between the audio amplifier module 513 and the switch module 550. Based on the impedance value measured through the impedance measurement module 512, the processor 510 may control the MUX circuit 1210 by the control signal module 511. For example, the processor 510 may control the MUX circuit 1210 step by step according to pre-stored configurations (e.g., an MUX table shown in Table 3 given below) of the external output device.

TABLE 3

| Terminal Status | Control bit (S3:S1) | $I_1$ | $I_2$ | $I_3$ | $I_4$ |
|---|---|---|---|---|---|
| Default (L+, L−, R+, R−) | 000 | $O_1$ | $O_2$ | $O_3$ | $O_4$ |
| L+, R+, L−, R− | 001 | $O_1$ | $O_3$ | $O_2$ | $O_4$ |
| L+, R+, R−, L− | 010 | $O_1$ | $O_3$ | $O_4$ | $O_2$ |
| R+, R−, L+, L− | 011 | $O_3$ | $O_4$ | $O_1$ | $O_2$ |
| R+, L+, R−, L− | 100 | $O_3$ | $O_1$ | $O_4$ | $O_2$ |
| R+, L+, L−, R− | 101 | $O_3$ | $O_1$ | $O_2$ | $O_4$ |
| | 110 | | Reserved | | |
| | 111 | | Reserved | | |

Based on the MUX table as shown in Table 3, the processor 510 may support the balanced type earphone. The MUX table shows example values about cases shown in FIG. 11 and is not to be considered as a limitation. When any balanced type connector of the output device is connected, the electronic device according to various embodiments may identify the configuration of the connector and then change a circuit based on the identified configuration. Namely, the electronic device may support balanced type output devices having various configurations by changing a circuit.

Figure 13:
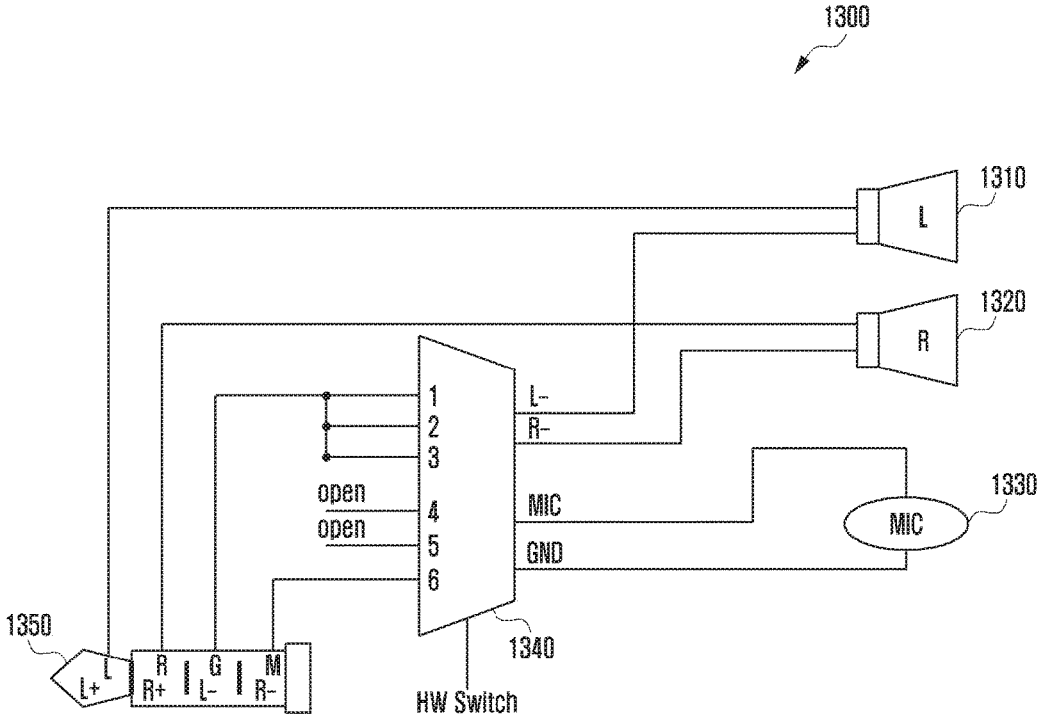
FIG. 13 is a diagram illustrating a configuration of a 4-pole balanced type output device having a microphone (MIC) according to various embodiments of the present disclosure.

FIG. 13 is a diagram illustrating the configuration of a 4-pole balanced type output device having a MIC according to various embodiments of the present disclosure.

Referring to FIG. 13, shown is a circuit configuration regarding an external output device 1300 having a MIC 1330. The external output device (e.g., earphone) 1300 has a left output part 1310 and a right output part 1320 and includes a connector 1350 and the MIC 1330. The external output device 1300 may be used as a balanced type output device before activating the function of the MIC 1330. When the function of the MIC 1330 is activated, the RING2 terminal 215 and the SLEEVE terminal 217 may be connected to the GND and the MIC, respectively. The function of the MIC 1330 may be activated in response to a user input on a suitable button equipped in the external output device 1300. In order to perform the above process, the external output device 1300 may add an MUX (hardware (HW) switch) 1340 therein. Table 4 given below shows an example of MUX operation when the balanced type external output device and the unbalanced type external output device are connected respectively. This further shows an example of MUX operation depending on whether the function of the MIC 1330 is activated or not.

TABLE 4

| | HW Switch (balanced) | HW Switch (unbalanced) |
|---|---|---|
| L− | Port 1 | Port 1 |
| R− | Port 6 | Port 2 |
| MIC | Port 4 | Port 6 |
| GND | Port 5 | Port 3 |

Referring to Table 4, in case of desiring to use the balanced type external output device 1300, L− (e.g., RING2 terminal) may be connected to Port 1 and also R− (e.g., SLEEVE terminal) may be connected to Port 6 so as to support a balanced type. In this case, MIC of the external output device 1300 may be in an open state by being connected to Port 4, and GND may be in an open state by being connected to Port 5. Additionally, when the MIC of the external output device 1300 is activated (e.g., a call is connected), the external output device 1300 may be switched to the unbalanced type. Namely, in order to use the MIC function, MIC (e.g., SLEEVE terminal) may be connected to Port 6, and GND (e.g., RING2 terminal) may be connected to Port 3.

Meanwhile, a method for activating the MIC during the use of the balanced type external output device 1300 is as follows. If any application (e.g., a call related application) using the MIC is invoked in a state of outputting a balanced audio signal, an impedance value or a voltage value may be checked again.

For example, when the external output device 1300 recognized as the unbalanced type changes the unbalanced type to the balanced type, a voltage value may be changed. The electronic device may detect an interrupt caused by such a change in voltage and measure again an impedance or voltage value of the external output device 1300. Then, based on the measured impedance or voltage value, the electronic device may change a circuit so as to support the balanced type external output device 1300. A change in type of the external output device 1300 may be detected through an impedance value as well as a voltage value.

According to various embodiments, when the balanced type external output device 1300 is changed to the unbalanced type, this change may be detected through measurement of an impedance value. For example, if the external output device 1300 is connected and continuously outputs audio signals, the electronic device may measure an impedance value of the external output device 1300. Since the output of audio signals means a continuous flow of current, impedance may be measured through the current. If no sound is outputted at the external output device 1300, the electronic device may measure impedance by periodically generating a pulse wave (frequency outside the band of audible sounds). Through this process, the electronic device may continuously measure the impedance of the external output device 1300. If an impedance value is changed, the electronic device may measure again an impedance value and a voltage value and, based on the measured impedance and voltage values, change the balanced type output to the unbalanced type output.

Figure 14A:
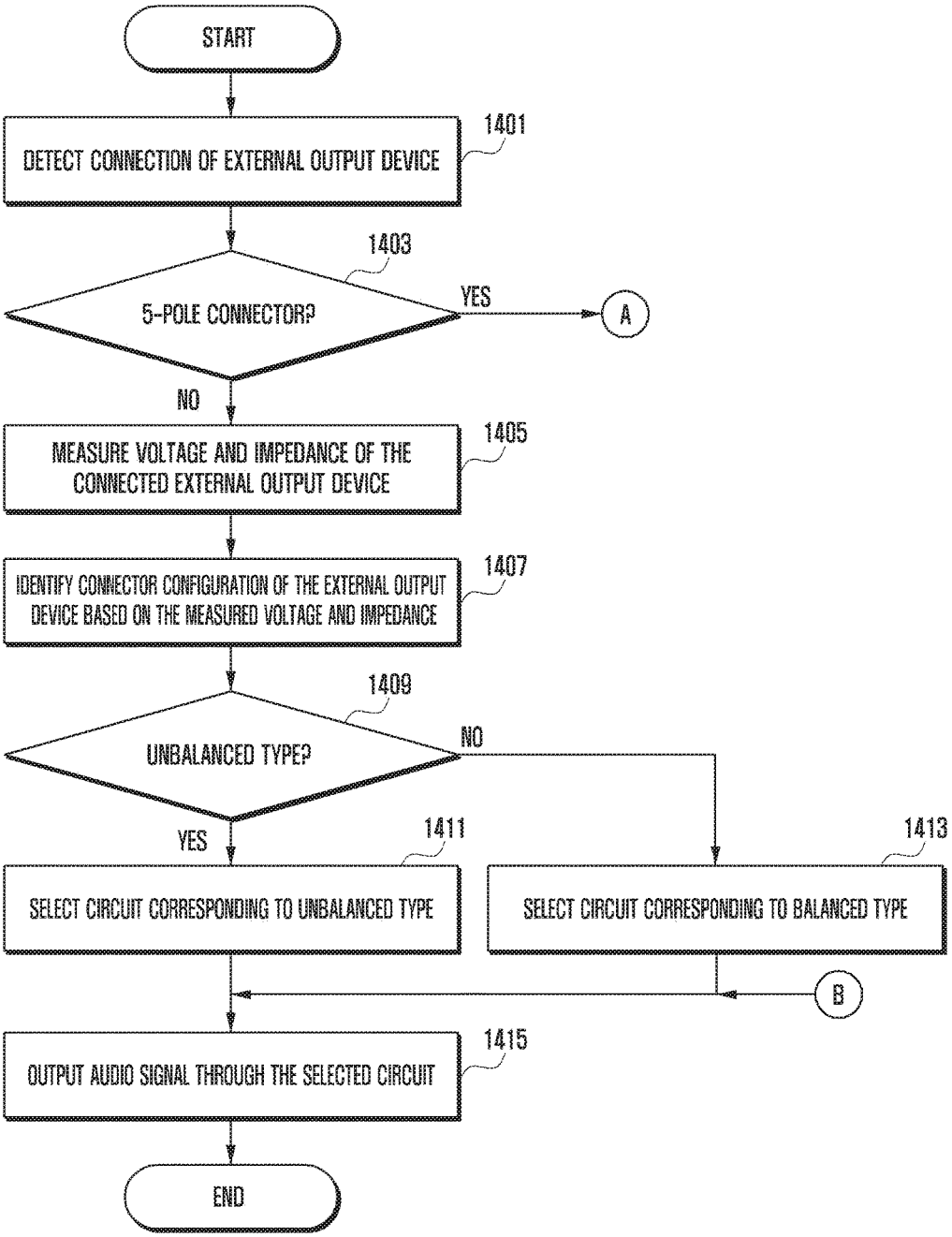
FIGS. 14A and 14B are flow diagrams illustrating operation of an electronic device when a 5-pole balanced type connector is connected to the electronic device according to various embodiments of the present disclosure.
Figure 14B:
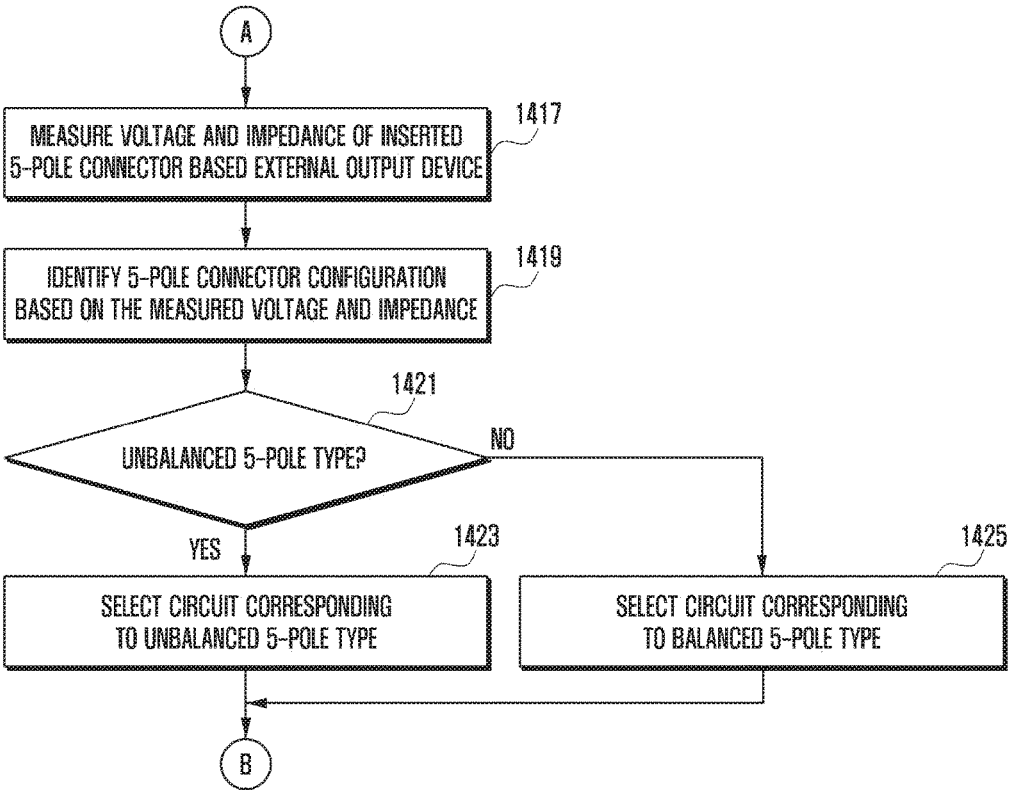

FIGS. 14A and 14B are flow diagrams illustrating the operation of an electronic device when a 5-pole balanced type connector is connected to the electronic device according to various embodiments of the present disclosure.

Referring to FIG. 14A, at operation 1401, the processor 510 of the electronic device 500 may detect the connection of the external output device 501. For example, the processor 510 may detect the connection of the external output device 501 through the connector detection module 516. At operation 1403, the processor 510 may determine whether the connector of the external output device 501 is 5-pole. The 5-pole connector is formed of five terminals, and the electronic device 500 may add any element so as to support the 5-pole connector. If it is determined at operation 1403 that the connector of the external output device 501 is not 5-pole, the processor 510 may measure voltage and impedance as to the connected external output device 501 at operation 1405. A process from operation 1405 to operation 1415 may be equivalent to the above discussed process from operation 703 to operation 711 in FIG. 7. So, detailed description about operations 1405 to 1415 will be omitted.

Meanwhile, if it is determined at operation 1403 that the connector of the external output device 501 is 5-pole, operations shown in FIG. 14B are performed. Referring to FIG. 14B, when the connector of the external output device 501 is 5-pole, the processor 510 may measure voltage and impedance as to the inserted 5-pole connector based external output device at operation 1417. This measuring operation is equivalent to the above-discussed operation in case of the 4-pole connector, so that detailed description will be omitted. At operation 1419, the processor 510 may identify the configuration of the 5-pole connector, based on the measured voltage and impedance. At operation 1421, the processor 510 may determine whether the 5-pole connector is an unbalanced type or a balanced type. If the 5-pole connector is an unbalanced type, the processor 510 may select a circuit corresponding to the unbalanced type at operation 1423. If the 5-pole connector is a balanced type, the processor 510 may select a circuit corresponding to the balanced type at operation 1425. Then, at operation 1415, the processor 510 may output an audio signal through the selected circuit.

In case the 5-pole connector is connected, the electronic device according to various embodiments may utilize the existing 4-pole terminals for a balanced type audio output and also utilize the fifth terminal as the GND. Therefore, the electronic device may transmit an audio signal more efficiently in comparison with 4-pole terminals.

Figure 15A:
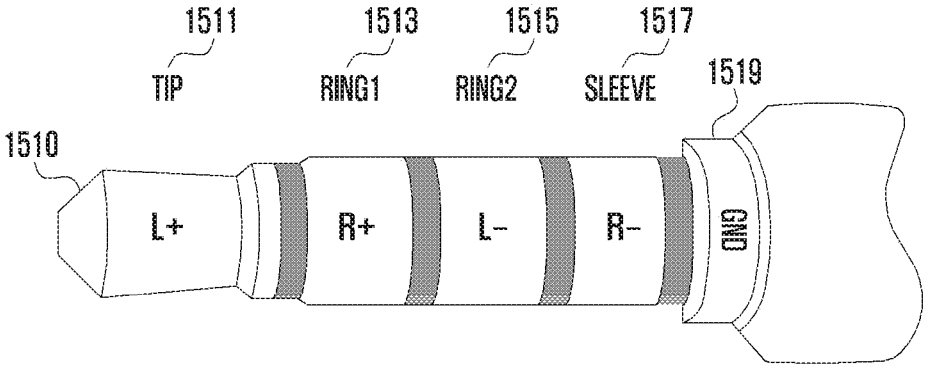
FIG. 15A is a diagram illustrating a 5-pole balanced type connector according to various embodiments of the present disclosure.
Figure 15B:
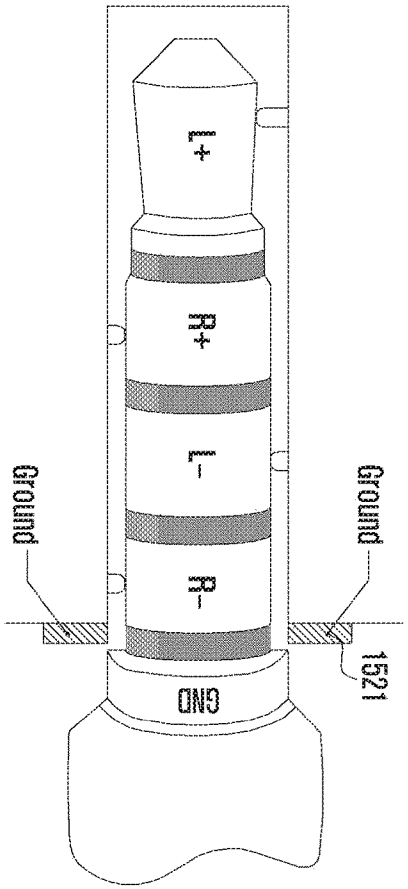
FIG. 15B is a diagram illustrating the connection between a 5-pole balanced type connector and an electronic device according to various embodiments of the present disclosure.

FIG. 15A is a diagram illustrating a 5-pole balanced type connector according to various embodiments of the present disclosure. FIG. 15B is a diagram illustrating the connection between a 5-pole balanced type connector and an electronic device according to various embodiments of the present disclosure.

Referring to FIG. 15A, shown is a 5-pole balanced type connector 1510 formed of five terminals. For example, the 5-pole balanced type connector 1510 may be formed of a TIP terminal 1511, a RING1 terminal 1513, a RING2 terminal 1515 and a SLEEVE terminal 1517 as being similar with the 4-pole connector, and may add the fifth terminal 1519. The 5-pole balanced type connector 1510 may be configured as the TIP terminal 1511 of L+, the RING1 terminal 1513 of R+, the RING2 terminal 1515 of L−, the SLEEVE terminal 1517 of R−, and the fifth terminal 1519 of GND.

FIG. 15B shows a state in which the 5-pole balanced type connector 1510 is connected to the electronic device. The electronic device may add a GND terminal 1521 so as to identify the fifth terminal 1519. Through the GND terminal 1521, the processor 510 may identify that the connected connector is a 5-pole connector.

Figure 16:
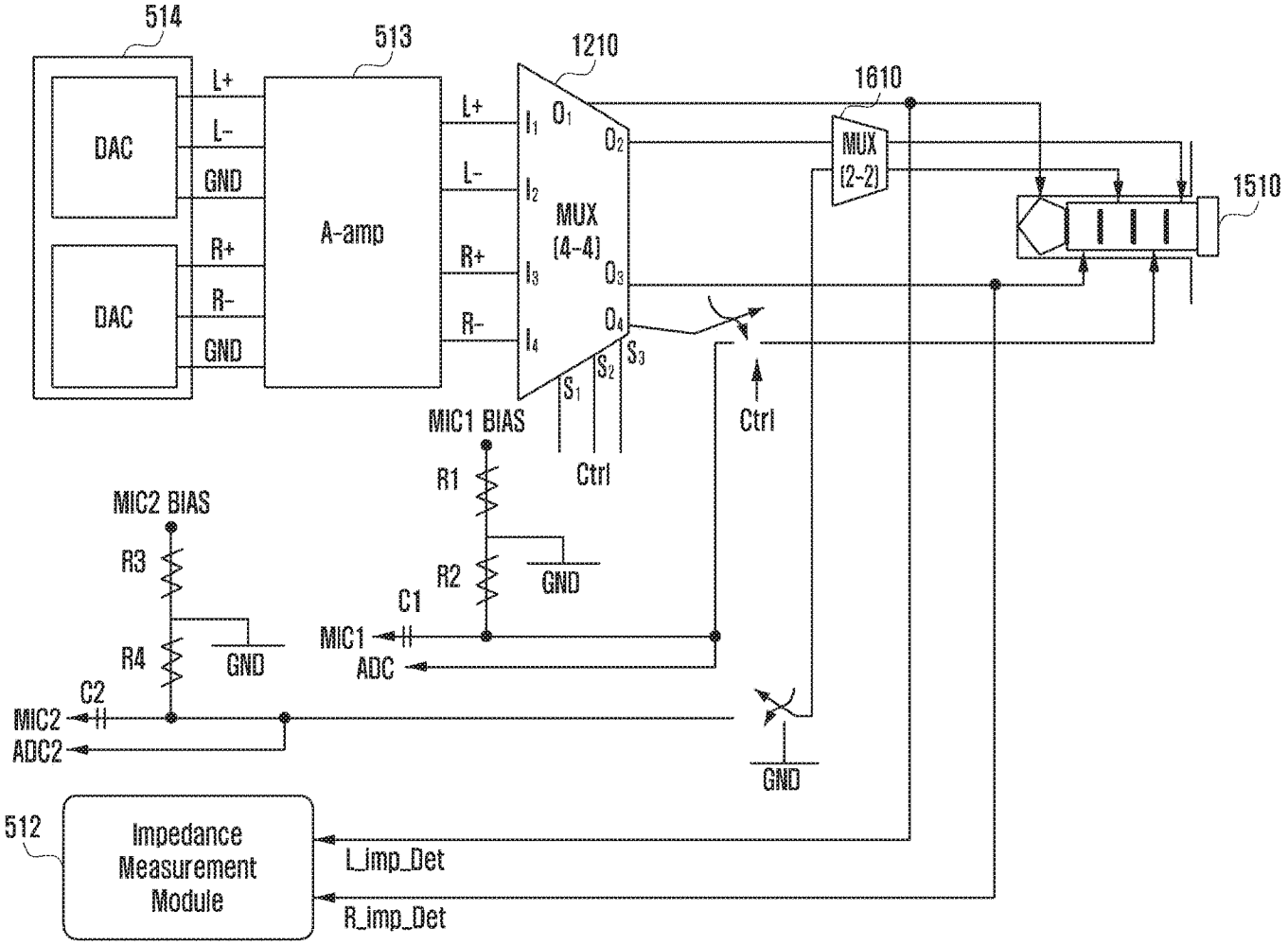
FIG. 16 is a diagram illustrating operation of an electronic device when a 5-pole balanced type connector is connected to an electronic device according to various embodiments of the present disclosure.

FIG. 16 is a diagram illustrating the operation of an electronic device when a 5-pole balanced type connector is connected to the electronic device according to various embodiments of the present disclosure.

Referring to FIG. 16, the electronic device 510 may include an additional element in addition to the existing elements so as to support the 5-pole balanced type connector. For example, the electronic device 510 may add a MUX[2-2] 1610 as an element associated with the fifth terminal 1519.

Hereinafter, the 5-pole connector is described. When the 5-pole connector is used as the unbalanced type, the fifth terminal 1519 may be used for another purpose. For example, the fifth terminal 1519 may be used for a reference MIC for suppressing noise. For this, the electronic device needs to have the reference MIC (e.g., the second MIC) therein. The electronic device having this configuration and supporting the 5-pole connector may be more effective in noise suppression.

The electronic device that supports the 5-pole balanced type connector may support the balanced type output by allocating L+, L−, R+ and R− to the existing 4-pole and also use the fifth terminal 1519 as the GND. The electronic device according to various embodiments may support the 5-pole connector by adding the MUX[2-2].

Figure 17:
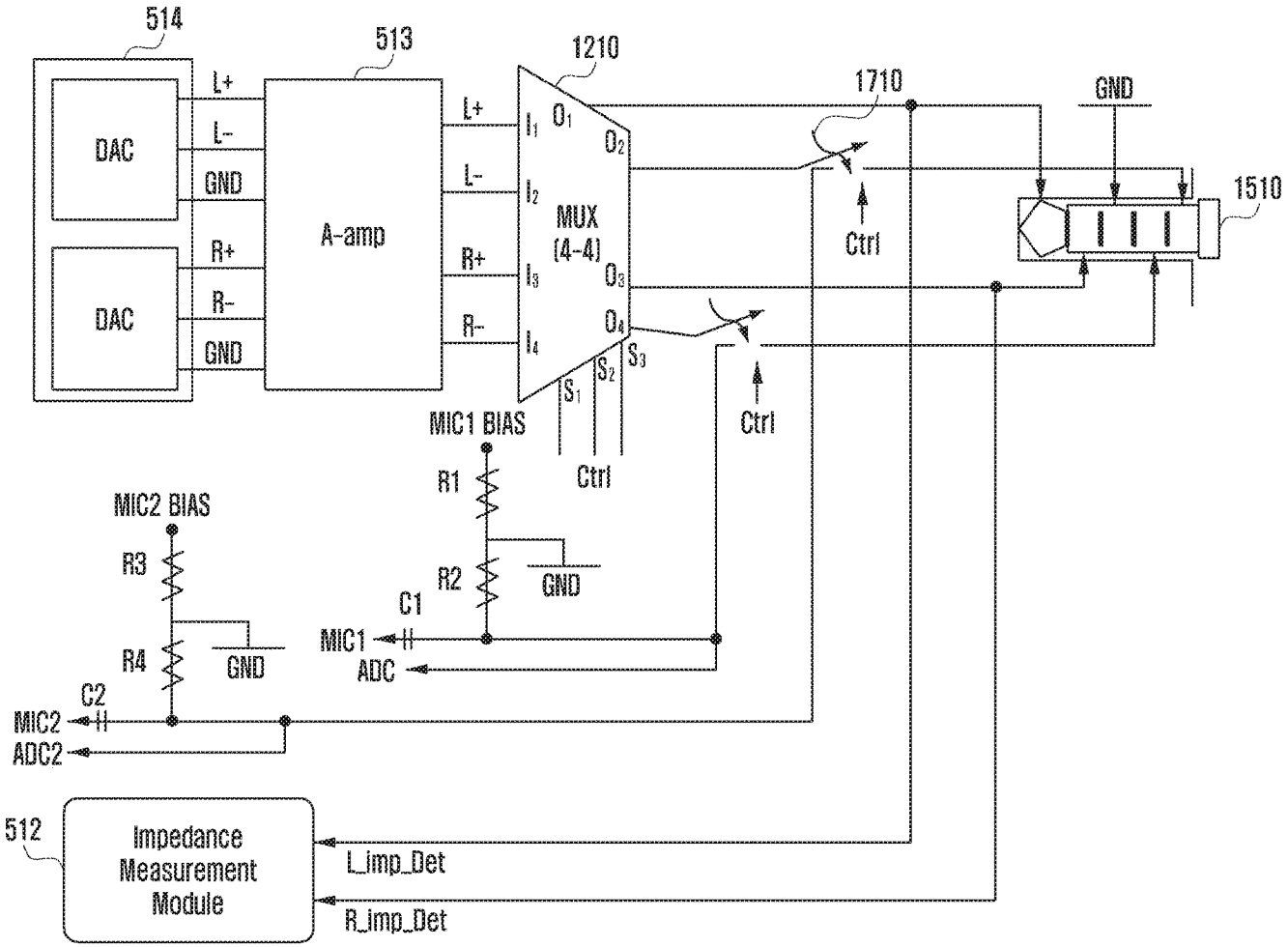
FIG. 17 is another diagram illustrating an operation of an electronic device when a 5-pole balanced type connector is connected to the electronic device according to various embodiments of the present disclosure.

FIG. 17 is another diagram illustrating the operation of an electronic device when a 5-pole balanced type connector is connected to the electronic device according to various embodiments of the present disclosure.

Referring to FIG. 17, a circuit configuration is almost similar to that shown in FIG. 16. Compared with FIG. 16, FIG. 17 shows a circuit in which the RING2 terminal is fixed to GND for the connection with the 5-pole connector. Since the RING2 terminal is fixed to GND, the electronic device shown in FIG. 17 may not require any additional MUX. Instead, the electronic device may add a switch 1710 for the fifth terminal 1519. Therefore, the electronic device may support the 5-pole connector.

The term "module" according to the various embodiments of the disclosure, means, but is not limited to, a unit of one of software, hardware, and firmware or any combination thereof. The term "module" may be used interchangeably with the terms "unit," "logic," "logical block," "component," or "circuit." The term "module" may denote a smallest unit of component or a part thereof. The term "module" may be the smallest unit of performing at least one function or a part thereof. A module may be implemented mechanically or electronically. For example, a module may include at least one of application-specific integrated circuit (ASIC) chip, field-programmable gate arrays (FPGAs), and programmable-logic device known or to be developed for certain operations.

According to various embodiments of the present disclosure, the devices (e.g. modules or their functions) or methods may be implemented by computer program instructions stored in a computer-readable storage medium. In the case that the instructions are executed by at least one processor (e.g. processor 120), the at least one processor may execute the functions corresponding to the instructions. The computer-readable storage medium may be the memory 130. At least a part of the programming module may be implemented (e.g. executed) by the processor 120. At least a part of the programming module may include modules, programs, routines, sets of instructions, and processes for executing the at least one function.

The computer-readable storage medium includes magnetic media such as a floppy disk and a magnetic tape, optical media including a compact disc ROM (CD ROM) and a DVD ROM, a magneto-optical media such as a floptical disk, and the hardware device designed for storing and executing program commands such as ROM, RAM, and flash memory. The programs commands include the language code executable by computers using the interpreter as well as the machine language codes created by a compiler. The aforementioned hardware device can be implemented with one or more software modules for executing the operations of the various embodiments of the present disclosure.

The module or programming module of the present disclosure may include at least one of the aforementioned components with omission of some components or addition of other components. The operations of the modules, programming modules, or other components may be executed in series, in parallel, recursively, or heuristically. Also, some operations may be executed in different order, omitted, or extended with other operations.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a housing;

a receptacle formed at a part of the housing so as to receive one of a first external connector and a second external connector; and a circuit electrically coupled to the receptacle, wherein the circuit is configured to:

detect whether one of the first and second external connectors is inserted into the receptacle, and if the first external connector is inserted, provide an audio output to the first external connector as an unbalanced audio signal, and if the second external connector is inserted, provide the audio output to the second external connector as a balanced audio signal.

2. The electronic device of claim 1, wherein the first external connector is connected to an external output device having first and second speakers or forms a part of the external output device, and wherein the circuit is configured to, when the first external connector is inserted, provide an audio output to the first and second speakers through two terminals selected from first, second, third, and fourth terminals of the first external connector.

3. The electronic device of claim 2, wherein the circuit is further configured to, when the first external connector is inserted, receive an audio signal from the external output device through another terminal selected from the first, second, third, and fourth terminals of the first external connector.

4. The electronic device of claim 1, wherein the second external connector is connected to an external output device having first and second speakers or forms a part of the external output device, and wherein the circuit is further configured to, when the second external connector is inserted:

provide a first audio output to the first speaker through two terminals selected from first, second, third, and fourth terminals of the second external connector, and provide a second audio output to the second speaker through other two terminals selected from the first, second, third, and fourth terminals of the second external connector.

5. The electronic device of claim 1, wherein the circuit includes a processor configured to perform at least one of the detection and the audio output.

6. The electronic device of claim 1, wherein the receptacle comprises:

first and second contacts configured to be in respective contact with two terminals selected from first, second, third and fourth terminals;

a first switch electrically coupled to the first contact; and a second switch electrically coupled to the second contact, wherein the circuit is electrically coupled to the first and second contacts, and wherein the circuit is further configured to:

provide, using at least the first switch, one of a first state of transmitting at least part of a left or right component of the audio output to the connector through the first contact and a second state grounding at least part of the connector, and provide, using at least the second switch, one of a third state of transmitting at least part of the left or right component of the audio output to the connector through the second contact and a fourth state of receiving a second sound, obtained at an external device electrically coupled to the connector, through the second contact.

7. The electronic device of claim 6, wherein the circuit is further configured to determine, at least partially based on impedance measured through at least part of the first, second, third, and fourth terminals, whether a connector inserted into the receptacle is the first external connector or the second external connector.

8. The electronic device of claim 7, wherein the circuit is further configured to drive the first switch or the second switch, at least partially based on the determination.

9. An electronic device comprising:

a housing;

a receptacle formed at a part of the housing so as to receive one of a first external connector and a second external connector; and a circuit electrically coupled to the receptacle, wherein the circuit is configured to:

detect whether one of the first and second external connectors is inserted into the receptacle, if the first external connector is inserted, provide an audio output to the first external connector as an unbalanced audio signal, and if the second external connector is inserted, provide the audio output to the second external connector as a balanced audio signal.

10. The electronic device of claim 9, wherein the receptacle comprises:

a first contact configured to be in contact with three terminals selected from first, second, third, fourth, and fifth terminals;

a second contact configured to be in contact with two terminals other than the terminals in contact with the first contact;

a first switch electrically coupled to the first contact; and a second switch electrically coupled to the second contact, wherein the circuit is electrically coupled to the first and second contacts, and wherein the circuit is further configured to:

provide, using at least the first switch, one of a first state of transmitting at least part of a left or right component of the audio output to the connector through the first contact and a second state of grounding at least part of the connector, and provide, using at least the second switch, one of a third state of transmitting at least part of the left or right component of the audio output to the connector through the second contact and a fourth state of receiving a second sound, obtained at an external device electrically coupled to the connector, through the second contact.

11. A method for controlling output through an external output device, the method comprising:

recognizing an insertion of a first external connector or a second external connector through a receptacle for receiving one of the first external connector and the second external connector;

detecting whether the inserted external connector is the first external connector or the second external connector;

if the first external connector is inserted, providing an audio output to the first external connector as an unbalanced audio signal; and if the second external connector is inserted, providing the audio output to the second external connector as a balanced audio signal.

12. The method of claim 11, wherein the first external connector is connected to an external output device having first and second speakers or forms a part of the external output device, and wherein the method further comprises, when the first external connector is inserted, providing an audio output to the first and second speakers through two terminals selected from first, second, third, and fourth terminals of the first external connector.

13. The method of claim 12, wherein the method further comprises, when the first external connector is inserted, receiving an audio signal from the external output device through another terminal selected from the first, second, third, and fourth terminals of the first external connector.

14. The method of claim 11, wherein the second external connector is connected to an external output device having first and second speakers or forms a part of the external output device, and wherein the method further comprises, when the second external connector is inserted, providing a first audio output to the first speaker through two terminals selected from first, second, third, and fourth terminals of the second external connector, and providing a second audio output to the second speaker through other two terminals selected from the first, second, third, and fourth terminals of the second external connector.

15. The method of claim 11, wherein the receptacle comprises:

first and second contacts configured to be in respective contact with two terminals selected from first, second, third, and fourth terminals, a first switch electrically coupled to the first contact, and a second switch electrically coupled to the second contact, and wherein the determining of the circuit electrically coupled to the receptacle includes:

determining, using at least the first switch, one of a first state of transmitting at least part of a left or right component of the audio output to the connector through the first contact and a second state of grounding at least part of the connector, and determining, at least using the second switch, one of a third state of transmitting at least part of the left or right component of the audio output to the connector through the second contact and a fourth state of receiving a second sound, obtained at an external device electrically coupled to the connector, through the second contact.

16. The method of claim 15, wherein the detecting of whether the inserted external connector is the first external connector or the second external connector comprises:

determining, at least partially based on impedance measured through at least part of the first, second, third, and fourth terminals, whether a connector inserted into the receptacle is the first external connector or the second external connector.

17. The method of claim 16, wherein the method further comprises driving the first switch or the second switch, at least partially based on results of the determining of whether the connector is the first external connector or the second external connector.

18. The method of claim 11, wherein the detecting and the providing of the audio output to the first or second external connector are performed by a processor of the external output device.

19. A method for controlling output through an external output device, the method comprising:

recognizing an insertion of a first external connector or a second external connector through a receptacle for receiving one of the first external connector and the second external connector;

detecting whether the inserted external connector is the first external connector or the second external connector;

if the first external connector is inserted, providing an audio output to the first external connector as an unbalanced audio signal; and if the second external connector is inserted, providing the audio output to the second external connector as a balanced audio signal.

20. The method of claim 19, wherein the receptacle includes:

a first contact configured to be in contact with three terminals selected from first, second, third, fourth, and fifth terminals;

a second contact configured to be in contact with two terminals other than the terminals in contact with the first contact;

a first switch electrically coupled to the first contact; and a second switch electrically coupled to the second contact, and wherein the determining of the circuit electrically coupled to the receptacle includes:

determining, using at least the first switch, one of a first state of transmitting at least part of a left or right component of the audio output to the connector through the first contact and a second state of grounding at least part of the connector, and determining, using at least the second switch, one of a third state of transmitting at least part of the left or right component of the audio output to the connector through the second contact and a fourth state of receiving a second sound, obtained at an external device electrically coupled to the connector, through the second contact.

* * * * *